US005402355A

United States Patent [19]

Bahlmann et al.

[11] Patent Number: 5,402,355

[45] Date of Patent: Mar. 28, 1995

[54] PROCESS AND DEVICE TO CONVEY BOBBINS OR BOBBIN-LIKE GOODS OF THE TEXTILE INDUSTRY

[75] Inventors: Bernd Bahlmann, Schrobenhausen; Michael Ueding, Ingolstadt; Udo Riedesel, Dortmund, all of Germany

[73] Assignee: Schubert & Salzer Maschinenfabrik AG, Ingolstadt, Germany

[21] Appl. No.: 163,400

[22] Filed: Dec. 7, 1993

Related U.S. Application Data

[63] Continuation of Ser. No. 585,102, Dec. 30, 1991, abandoned.

[30] Foreign Application Priority Data

Apr. 7, 1989 [DE] Germany ..... 39 11 451.1

[51] Int. Cl.[6] ..... G06F 15/50; D01H 9/18

[52] U.S. Cl. ..... 364/478; 364/470; 57/264; 104/88.03; 104/88.04; 242/35.5 A

[58] Field of Search ..... 364/468, 478, 470; 198/341, 349; 57/264, 276, 281; 104/88, 88 R, 88 C, 88 F, 88 D, 88 G, 88 H; 901/1; 242/35.5 A; 414/911

[56] References Cited

U.S. PATENT DOCUMENTS

| | | | |
|---|---|---|---|
| 3,049,247 | 8/1962 | Lemelson et al. | 198/349 |
| 4,053,741 | 10/1977 | Ainoya et al. . | |
| 4,351,494 | 9/1982 | Schippers et al. | 242/35.5 A |
| 4,441,660 | 4/1984 | Cloud et al. | 242/35.5 A |
| 4,491,301 | 1/1985 | Pendola . | |
| 4,554,873 | 11/1985 | Rex | 104/88 |
| 4,669,047 | 5/1987 | Chucta | 364/478 |
| 4,679,149 | 7/1987 | Merz . | |
| 4,686,813 | 8/1987 | Sawada . | |
| 4,688,300 | 8/1987 | Langen et al. . | |
| 4,698,775 | 10/1987 | Koch et al. | 364/478 |
| 4,720,967 | 1/1988 | Guttler . | |
| 4,729,709 | 3/1988 | Raasch . | |
| 4,821,504 | 4/1989 | Shinkai et al. | 242/35.5 A |
| 4,924,999 | 5/1990 | Kikuchi et al. . | |
| 4,926,753 | 5/1990 | Weiss | 104/88 |
| 4,997,336 | 3/1991 | Galbani | 414/911 |
| 5,138,558 | 8/1992 | Meyer et al. | 364/478 |

FOREIGN PATENT DOCUMENTS

| | | |
|---|---|---|
| 0072571 | 2/1983 | European Pat. Off. . |
| 0309026 | 3/1989 | European Pat. Off. . |
| 0347311 | 12/1989 | European Pat. Off. . |
| 3332899A1 | 3/1985 | Germany . |
| 3434268 | 3/1986 | Germany . |
| 3532172A1 | 3/1987 | Germany . |
| 3614654A1 | 11/1987 | Germany . |
| 3824874A1 | 2/1989 | Germany . |
| 996728 | 6/1965 | United Kingdom . |
| 2204434 | 11/1988 | United Kingdom . |

OTHER PUBLICATIONS

Fördern und Heben 34 No. 11, 1984, pp. 829–833.
Fördern und Heben 25 No. 7, 1975, pp. 726–728.
Journal Article —Rechnergestutzte Transportsysteme in der Textilen Fertigung 66 (1985) Jul, No. 7, Heidelberg, Germany pp. 499–503.

*Primary Examiner*—Roy N. Envall, Jr.
*Assistant Examiner*—Steven R. Garland
*Attorney, Agent, or Firm*—Dority & Manning

[57] ABSTRACT

The instant invention relates to a process and to devices to convey textile goods from a receiving point to a point of deposit as well as for reception and deposit of the goods by means of a traveling vehicle. The goods to be conveyed are readied at the receiving points and are entered by a central computer. A conveying command is then elaborated by the central computer and is transmitted to a computing unit of the vehicle. The conveying vehicle is equipped with equipment for the autonomous and active execution of the conveying command. Upon completion of the conveying command, the vehicle reports back to the central computer. The conveyed goods are deposited in a sorted state.

49 Claims, 11 Drawing Sheets

PROCESS AND DEVICE TO CONVEY BOBBINS OR BOBBIN-LIKE GOODS OF THE TEXTILE INDUSTRY

This is a continuation of application U.S. Ser. No. 07/585,102, filed Dec. 30, 1991, which was abandoned upon the filing hereof.

BACKGROUND OF THE INVENTION

The instant invention relates to a process and to devices to convey goods from a receiving point to a point of deposit as well as to the reception and the deposit of the goods by means of a vehicle.

Control processes of goods in which the conveying vehicles are in constant contact with a central minicomputer which supervises all vehicles being used are known. The vehicles are in that case assisted to a great extent in carrying out their task by equipment at the edge of the travelling road.

In the textile industry bobbins or bobbin-like goods are used with many different processing machines, must be sorted out by quality, and be conveyed to the stations of subsequent processing. This is particularly the case with ring spinning machines, open end spinning machines, doubling and winding machines as well as with winding machines. Goods produced with these machines are conveyed to machines such as winding machines, packing machines etc. for further processing, or are placed in intermediate storage from which they can be taken for processing. A process and a device for the orderly transfer of cross bobbins is thus known from DE 33 32 899 A1. The cross bobbins produced in a cross bobbin production unit are collected in a buffer magazine at the cross bobbin production unit and are automatically transferred one after the other to a circular conveyor. The circular conveyor consists essentially of a chain to which hooks are attached at regular intervals. The chain runs through a driving device by means of which the chain is moved. Sensors are used to recognize previously selected conveying hooks at which counting of the following hooks is started. The bobbins hanging from the conveying hooks are thus continuously counted. Controllable automatic bobbin depositing devices place the cross-bobbins to be conveyed on free hooks of the circular conveyor. A programmable data processing device remembers the number of the hook and as soon as the hook has arrived at the point of removal the cross-bobbin is removed from the hook.

It is a disadvantage with this system that handling equipment must be provided at each receiving point and point of deposit by means of which the bobbins are placed on the hooks or are again removed from said hooks. This is costly on the one hand, since many handling devices and hooks are required. On the other hand the flexibility of such a system suffers from the fact that no bifurcation from a circular course is possible in such a circular conveyor. Furthermore the length of a circular conveyor is limited by the maximum length of the chain or the maximum conveying capacity of the chain drive.

A trolley conveyor is furthermore known from DE 38 24 874 A1 which is used to convey bobbins. The bobbins arriving from the winding machines are conveyed by vehicles of the trolley conveyor to a downstream processing station. It is characteristic for this system that the bobbins are arranged one after the other in conveying direction and that the bobbin axis is vertical. This makes it possible to use passive grasping elements on the vehicles which react exclusively to a counter-pressure. The slavers are comparable in type and operation to the so-called Casablanca holders. The bobbins are presented for reception according to the placement of the slavers on the vehicles at a precisely defined distance. The holding equipment is lowered and when it has been lowered to a set height the bobbins are connected to the holding device and are moved into an upper position. At the point of deposit the bobbins are again lowered, whereby the holders detach themselves from the bobbins as a counter-force makes itself felt.

The disadvantage with this system is the fact that intelligent handling systems must be installed at the receiving points as well as at the points of deposit to move the bobbins into a precisely defined position or to shift pallets at the point of deposit into the position in which the bobbins are to be set down on the pallet. This means high costs for a system with many receiving and depositing points.

Control of a driver-less conveying system to convey spinning cans is known from DE 35 32 172 A1. The carriage control of this system is in constant contact with the central control unit. The central computer informs the control of the conveying carriage of the arrival at the carder, the reception of the can at the carder, the conveying trip from the carder to the drawing frame and the discharge of the cans at the drawing frame. The conveying vehicle thus executes in every instance the command pertaining to an activity. When the command has been executed the vehicle is again ready for the next command. It is a disadvantage in this system that the central computer must carry a heavy work-load as it must supervise all the conveying carriages in use, so that waiting times may affect the conveying carriages until the next order is received.

OBJECTS AND SUMMARY OF THE INVENTION

It is therefore a principal object of the instant invention to create processes and devices to convey in particular goods of the textile industry flexibly, economically and rapidly from receiving stations to depositing stations and to deposit them there to be ready for further processing.

According to the invention, the conveying command is composed by a central computer which determines the receiving and depositing stations as well as the travelling road therebetween. This conveying command is then transmitted by the central computer to the computing unit of a vehicle and is then executed automatically by said vehicle through reception and deposit of the goods to be conveyed. It is advantageous here that the central computer is not strained during the execution of the conveying command. The vehicle reports back to the central computer only when the command has been executed. In the meantime, the central computer has the capacity to develop conveying commands for other vehicles or to control other equipment in the system. It is advantageous for the conveying command to be developed and to be transmitted to a vehicle only when a maximum quantity of goods that the vehicle is able to convey has been put at disposal.

The transmission of the data of the conveying command and/or of the acknowledgement of the vehicle to the central computer is provided for by a conveying itinerary segment. This ensures advantageously that the equipment ensuring contact between the two computers must be installed only within the segment of the travelling road provided for this. On the other hand it may also be advantageous, in special cases, e.g. malfunction, for the computing unit of the vehicle to be enabled to address the central computer or vice versa independently of the location of the vehicle at that time. The vehicle can receive new instructions from the central computer in that case.

On a travelling road provided with switches, the vehicle is advantageously equipped with signaling devices so as to signal switch positions of the travelling road according to command. If the vehicle heads for a switch, it is briefly stopped before entering the switch. The vehicle then indicates by means of a light signal, e.g. light/dark, or of an indicator, e.g. in or out for instance, in which direction the switch must be set. Similar switches are also advantageous before curves to ensure that the curve area is free of preceding vehicles. For as long as a vehicle is in a curved area, the influence exerted upon the drive of the following vehicle prevents it from entering the area of the curve.

Specific depositing stations are assigned to the different receiving stations to ensure well-sorted depositing of bobbins or bobbin-like goods of the textile industry. Well-sorted depositing ensures advantageously that repeated handling of the goods to sort them for further processing is avoided. Expenses and time are thereby saved. The goods are sorted in that case according to process-variables such as sizes, form and/or quality. This sorting process can be carried out at reception of the goods as well as at deposit of the goods.

The object of the invention is also attained by means of a conveying system for the conveying of goods from a receiving station to a depositing station with at least one vehicle to receive, transport and deposit these goods. The conveying system is characterized in that data with the information concerning a conveying command can be transmitted from a central computer to a computing unit of a vehicle and, in that the vehicles are equipped with devices for automatic and active execution of the conveying command. The vehicles thus contain all the devices to carry out the conveying command without further contact with the central computer. All essential equipment for handling of the goods to be conveyed, as well as for the control of the precise stopping positions, are contained in the vehicle.

The object of the instant invention is also attained by means of an electrically driven trolley conveyor with a vehicle containing equipment to process a conveying command. A computing unit which communicates with the central computer and equipment to drive, control, set the switches and handle the goods to be conveyed are provided on the vehicle. If the handling equipment is pneumatically driven, equipment for the production of compressed air is also provided on the vehicle.

If the electrically driven trolley conveyor conveys bobbins or bobbin-like goods, the handling equipment is provided with grasping devices with graspers to seize bobbins or bobbin-like goods at their circumferential surface. The bobbins are advantageously conveyed in an essentially horizontal position and perpendicularly to the conveying direction. If the grasping devices can be triggered independently of each other, the goods can be taken up at different receiving stations and/or can be deposited at different depositing stations. An especially non-damaging manner of handling the bobbins is achieved in that the opening width of the graspers can be changed by means of a parallelogram guidance. In this way no great frictional forces are applied to the bobbins or to the yarn wound up on said bobbins. To avoid dropping conveyed goods in case of a power outage, mechanical locking is provided to secure the bobbins by catching them.

Additional objects and advantages of the invention will be set forth in part in the description which follows, or may be learned by practice of the invention. The objects and advantages of the invention may be realized and attained by means and instrumentalities and combinations particularly pointed out in the appended claims.

The instant invention is explained below in greater detail through the drawings. The examples of embodiments relate to an electrically driven trolley conveyor. However, conveying carriages of driver-less conveying systems, e.g. for the conveying of spinning cans, are also covered in analogous fashion by the instant invention.

Figure 3:
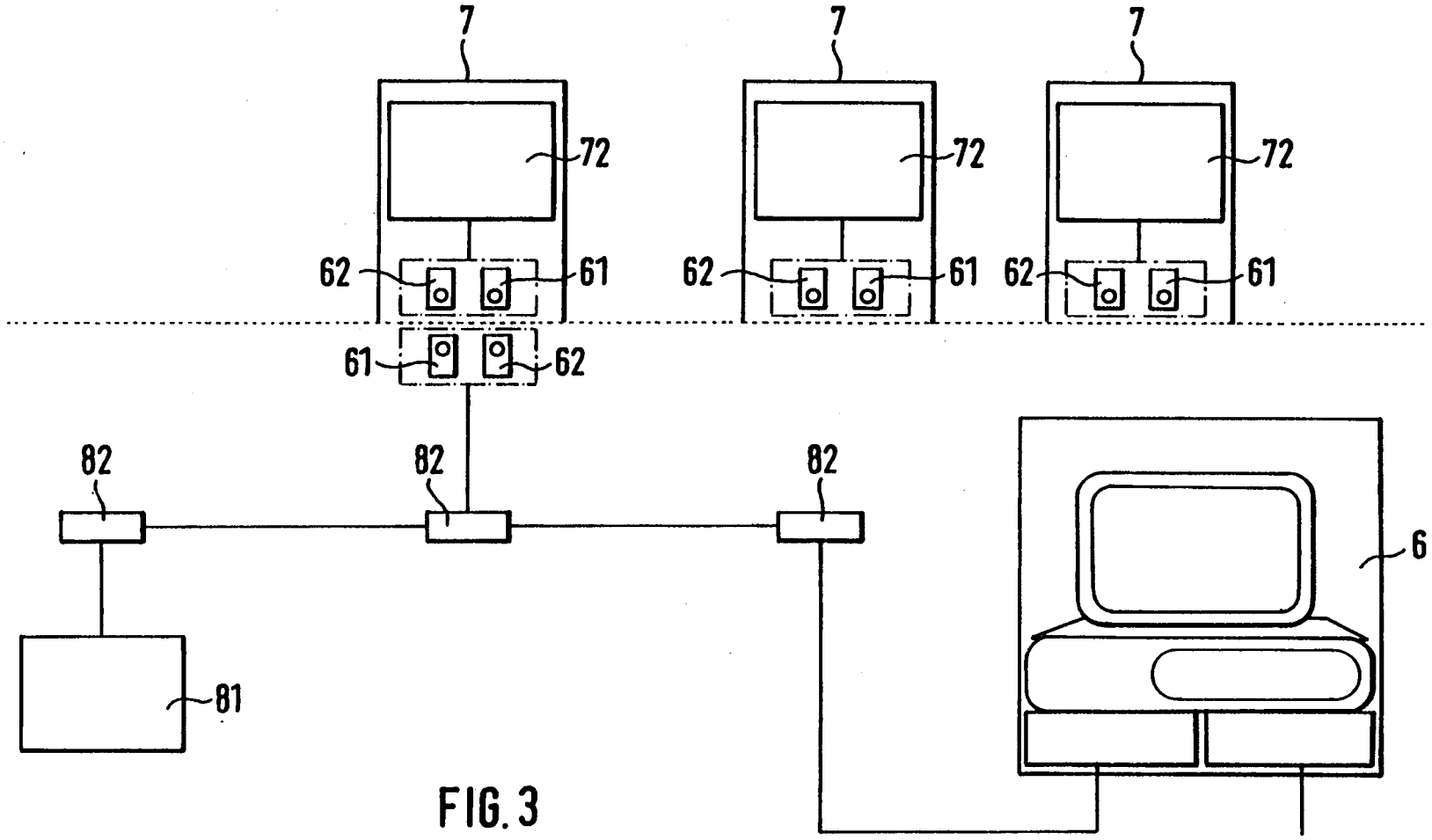
Figure 4:
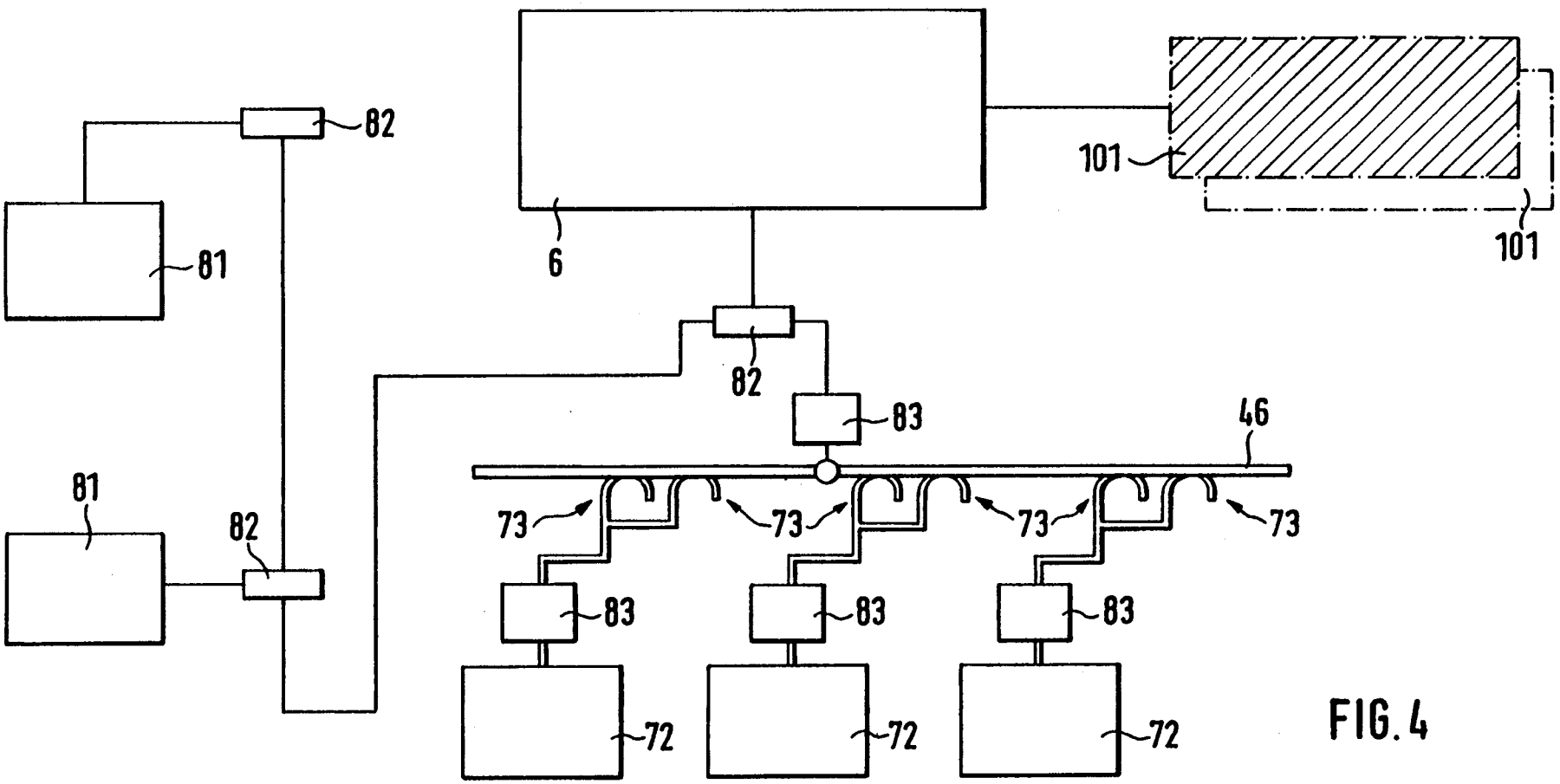
Figure 5:
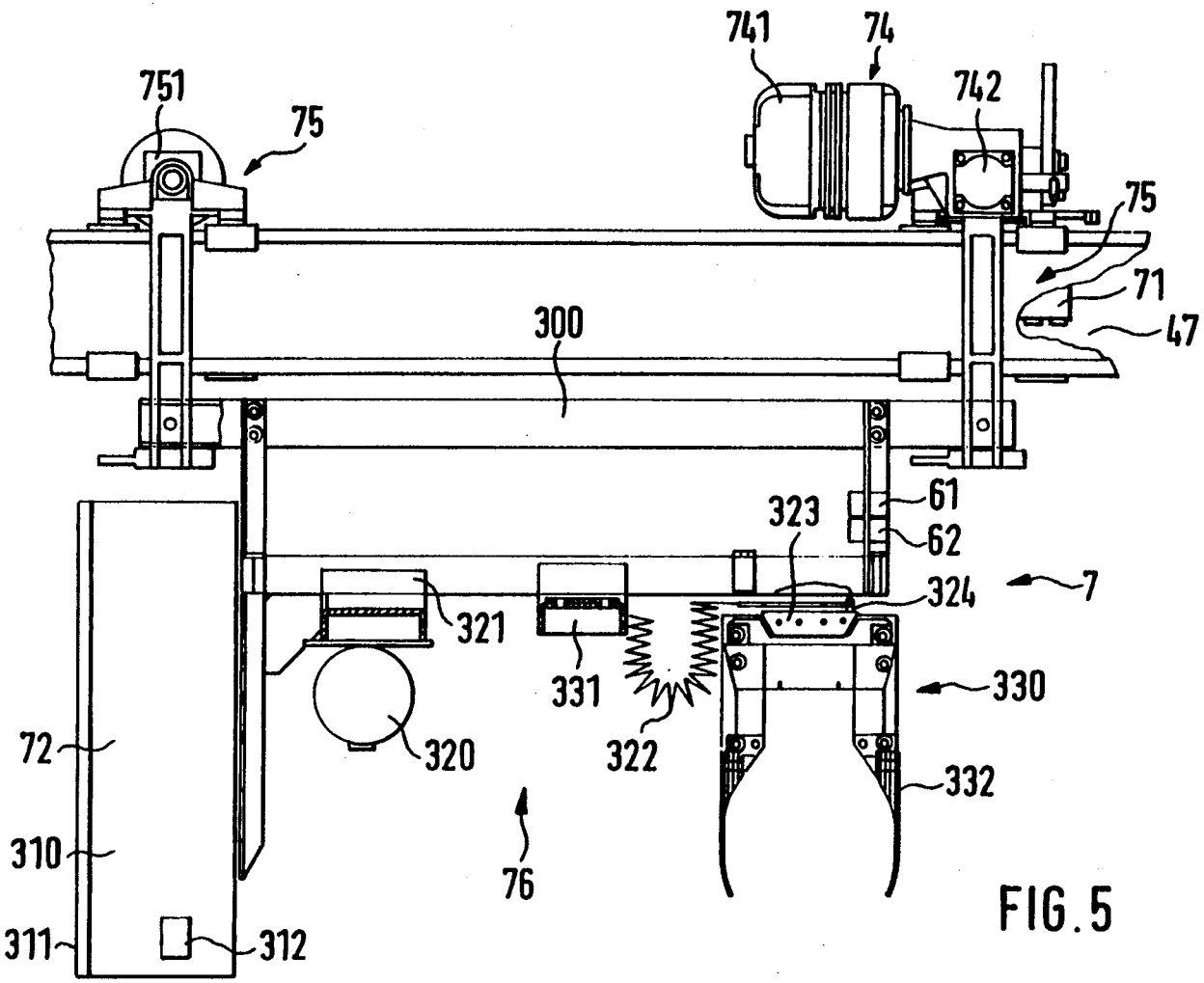
Figure 6:
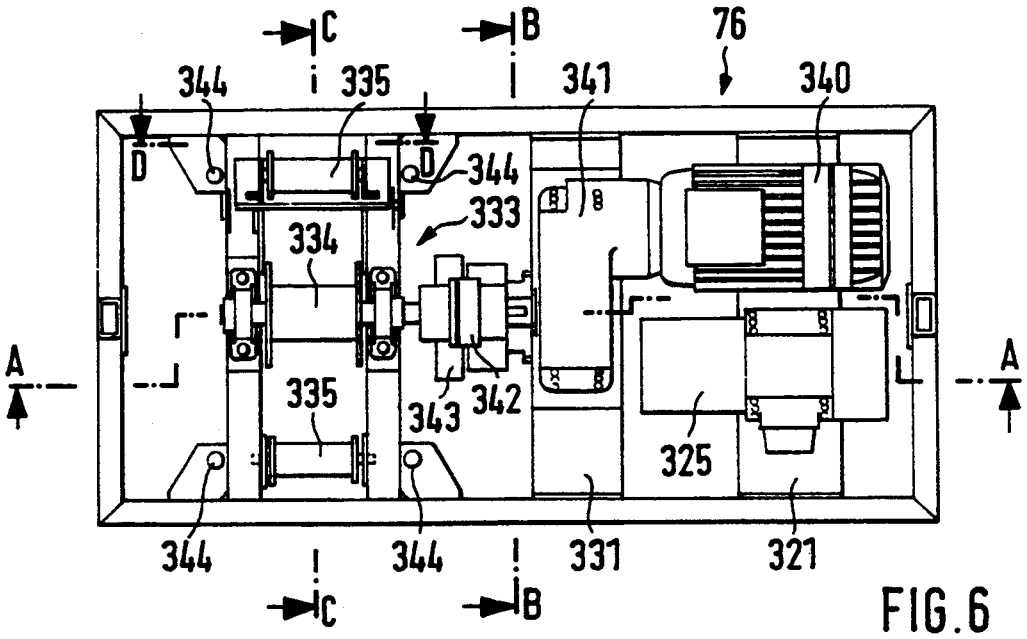
Figure 7:
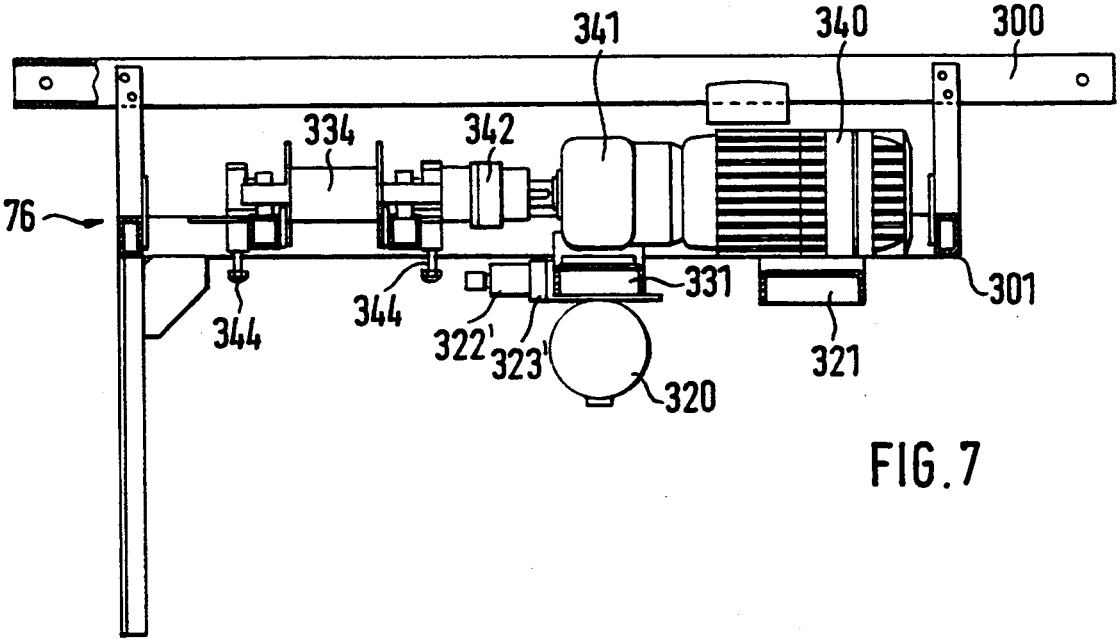
Figure 8:
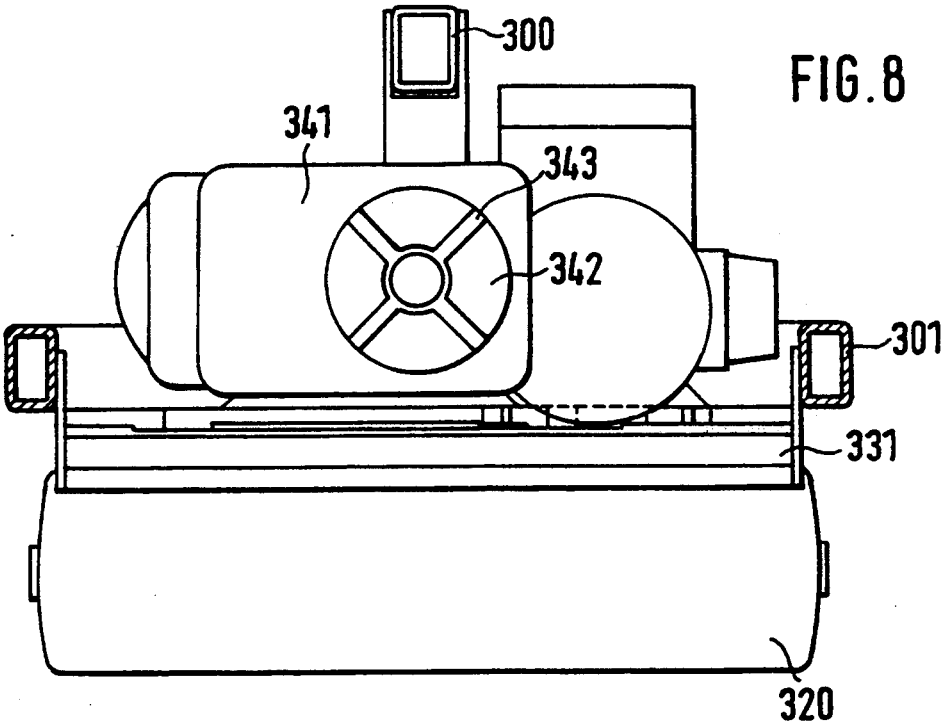
Figure 9:
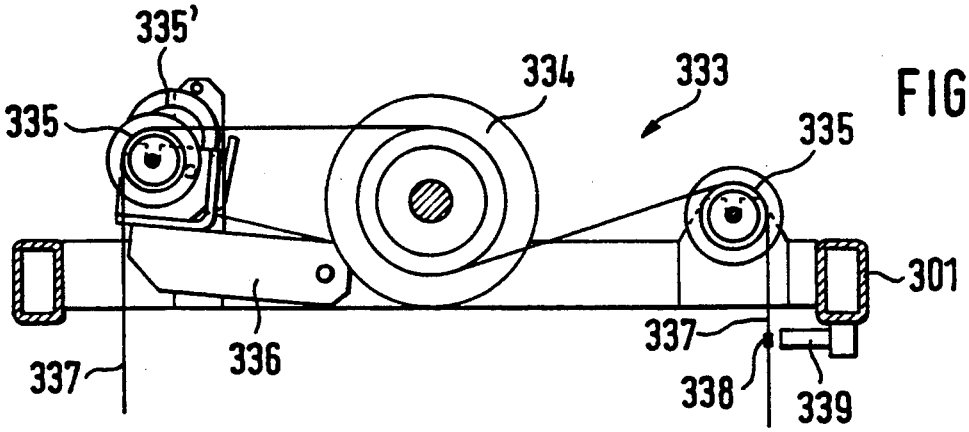
Figure 10:
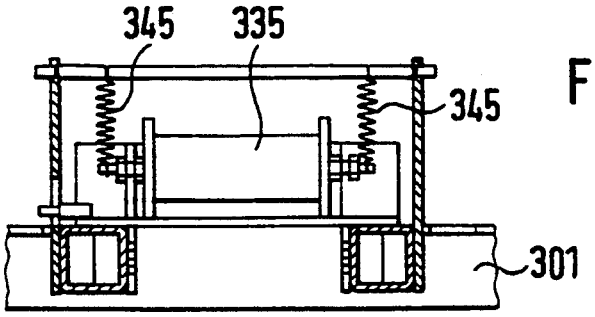
Figure 13:
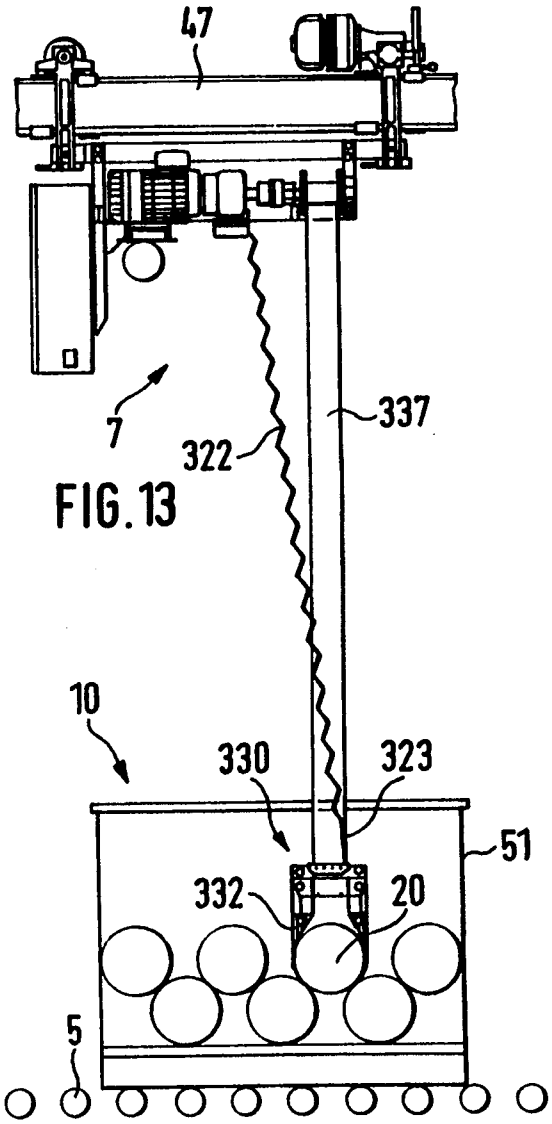
Figure 12:
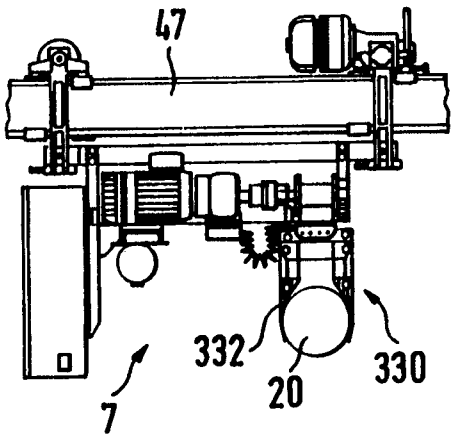
Figure 11:
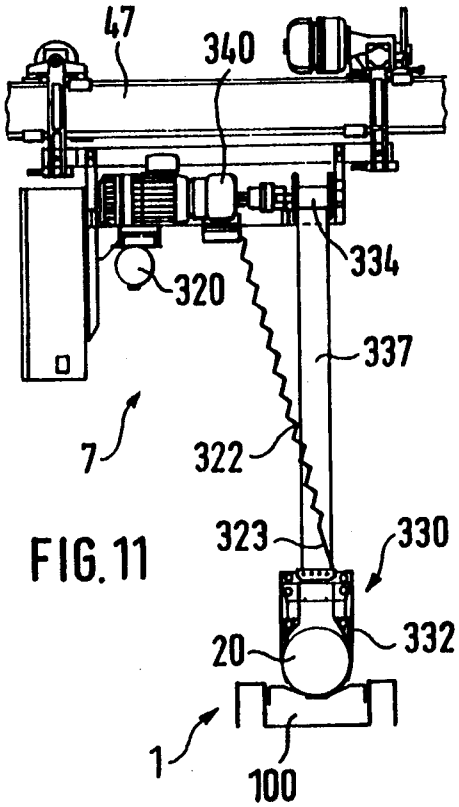
Figure 14:
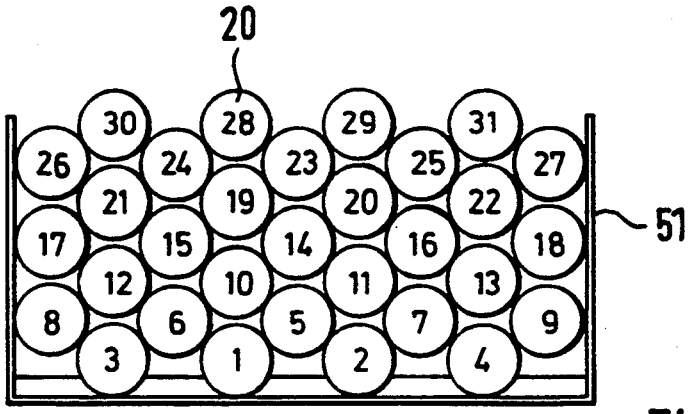
Figure 15:
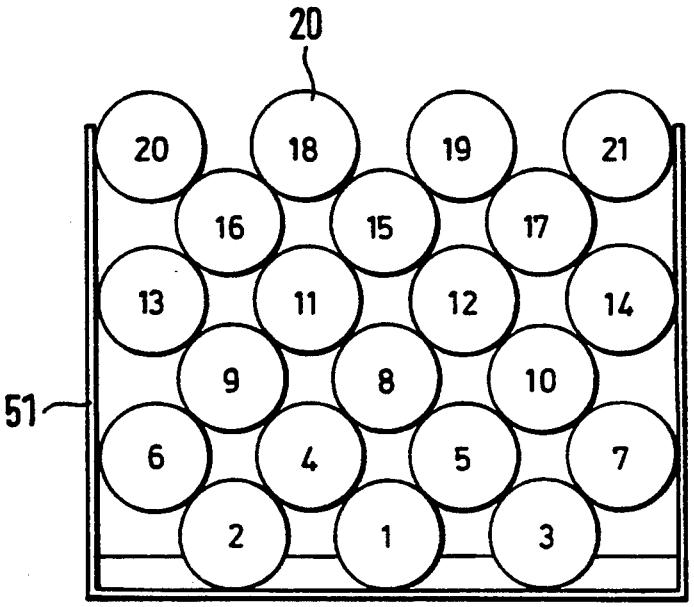
Figure 16:
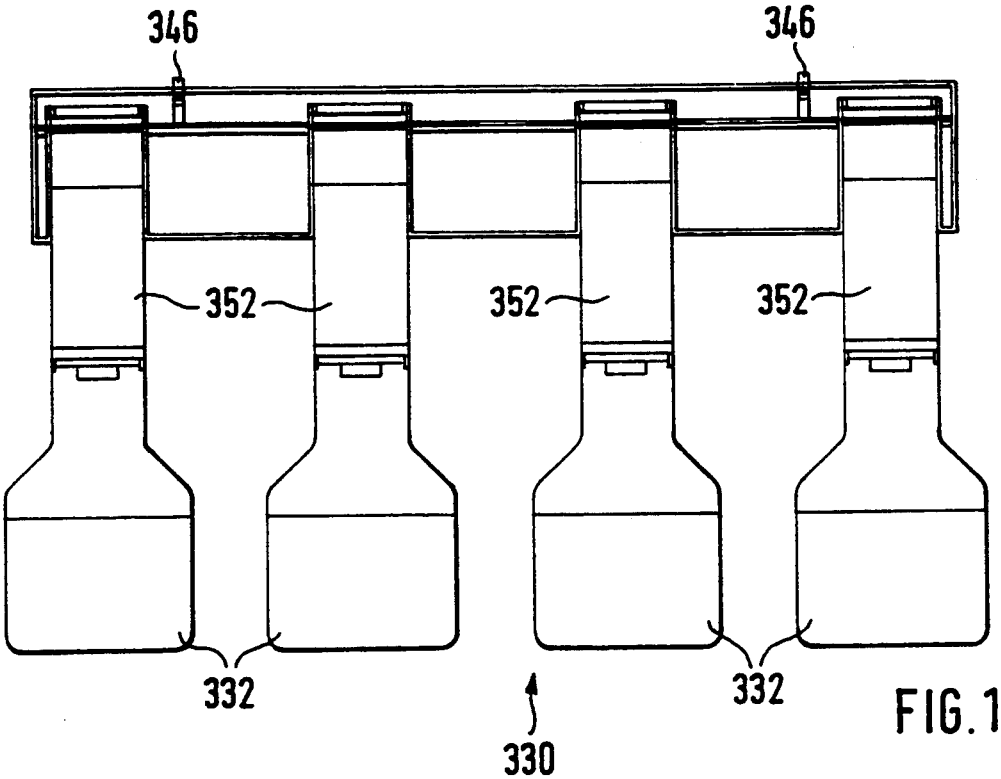
Figure 17:
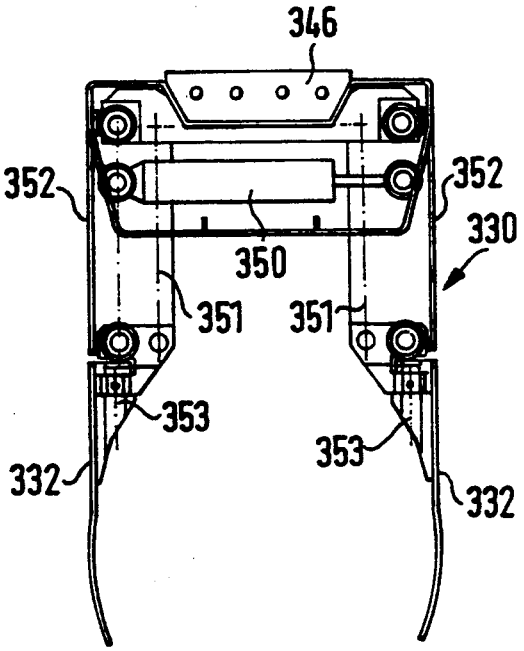
Figure 18:
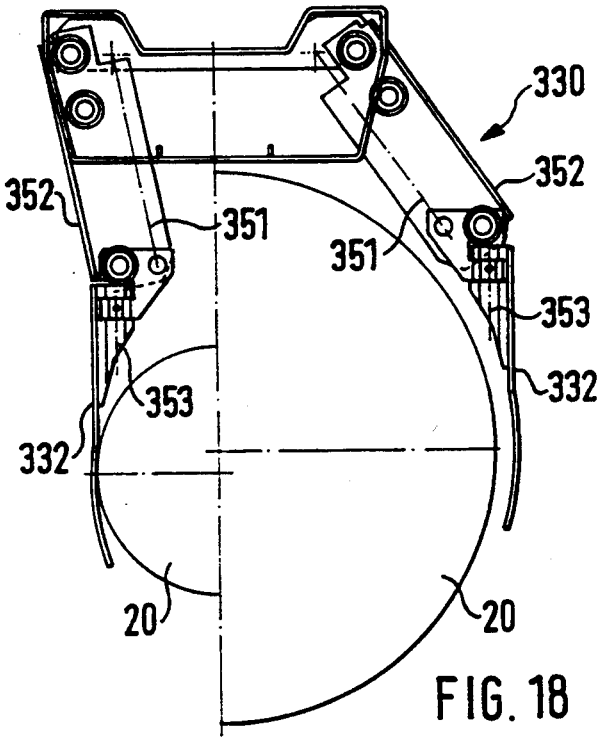
Figure 19:
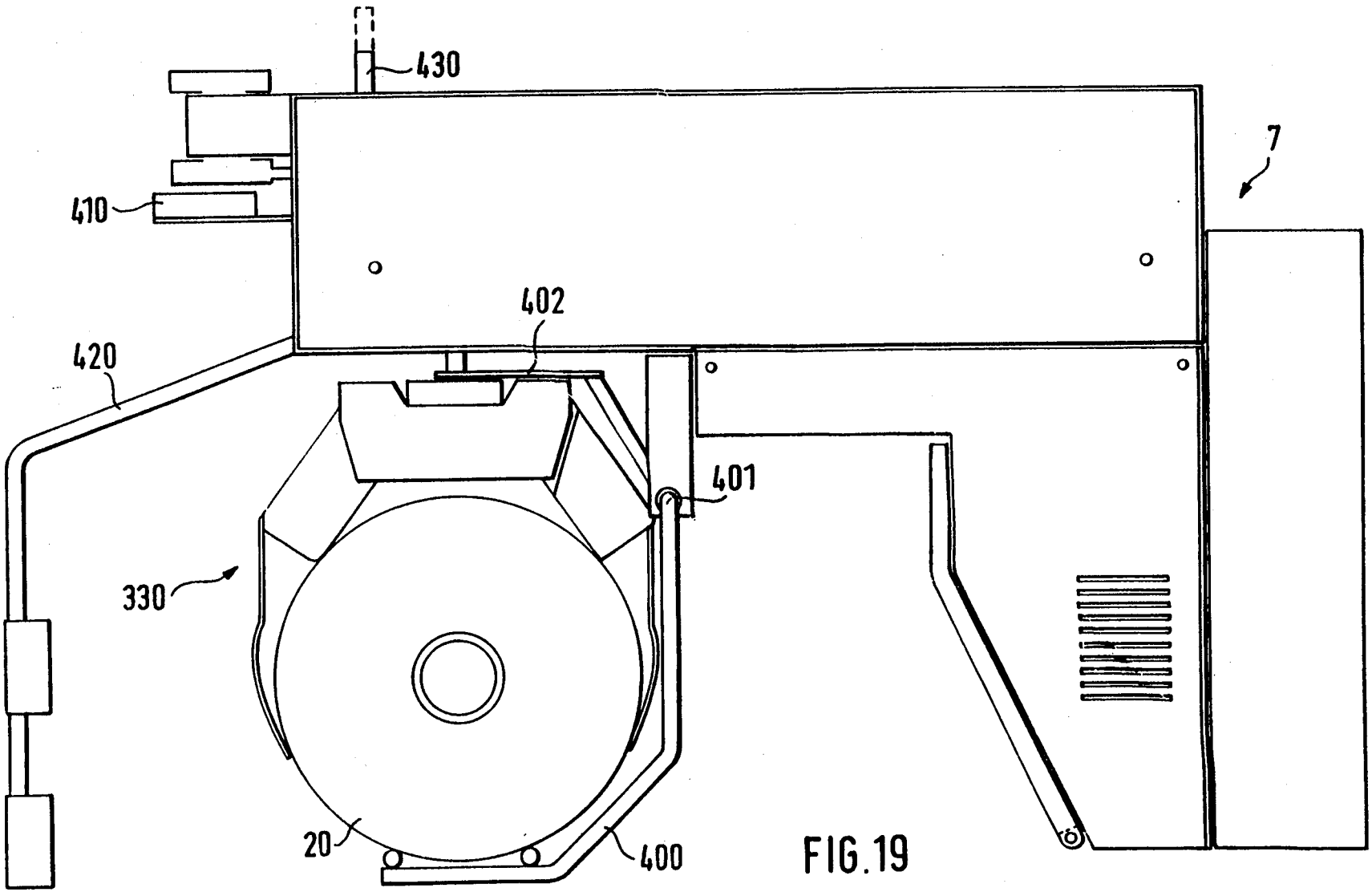

FIG. 3 shows an infrared data transmission system between stationary and mobile portions of the controls of the system;

FIG. 4 shows data transmission via sliding contacts between stationary and mobile portions of the controls of the system;

FIG. 5 shows a side-view of a conveying vehicle;

FIG. 6 shows a suspension tackle of the conveying vehicle in a top view;

FIG. 7 shows a suspension tackle of the conveying vehicle in a section A—A indicated in FIG. 6;

FIG. 8 Shows a suspension tackle of the conveying vehicle in a section B—B indicated in FIG. 6;

FIG. 9 shows a suspension tackle of the conveying vehicle in a section C—C indicated in FIG. 6;

FIG. 10 shows a suspension tackle of the conveying vehicle in a section D—D indicated in FIG. 6;

FIG. 11 shows a vehicle in receiving position;

FIG. 12 shows a vehicle in conveying position;

FIG. 13 shows a vehicle in depositing position;

FIG. 14 shows a depositing sequence of bobbins with small diameter into a container;

FIG. 15 shows a depositing sequence of bobbins with large diameter into a container;

FIG. 16 shows a handling system in frontal view;

FIG. 17 shows a handling system in lateral view;

FIG. 18 shows a handling system in half-section in the process of grasping bobbins with different diameters;

FIG. 19 shows a vehicle with safety devices.

DESCRIPTION OF THE PREFERRED EMBODIMENTS

Reference will now be made in detail to the present preferred embodiments of the invention, one or more examples of which are illustrated in the accompanying drawings. Each example is provided by way of explanation of the invention, not limitation of the invention. It will be apparent to those skilled in the art that various modifications and variations can be made in the invention without departing from the scope or spirit of the invention. For instance, features illustrated or described as part of one embodiment, can be used on another embodiment to yield a still further embodiment. The numbering of components in the drawings is consistent throughout the application, with the same components having the same number in each drawing.

Figure 1:
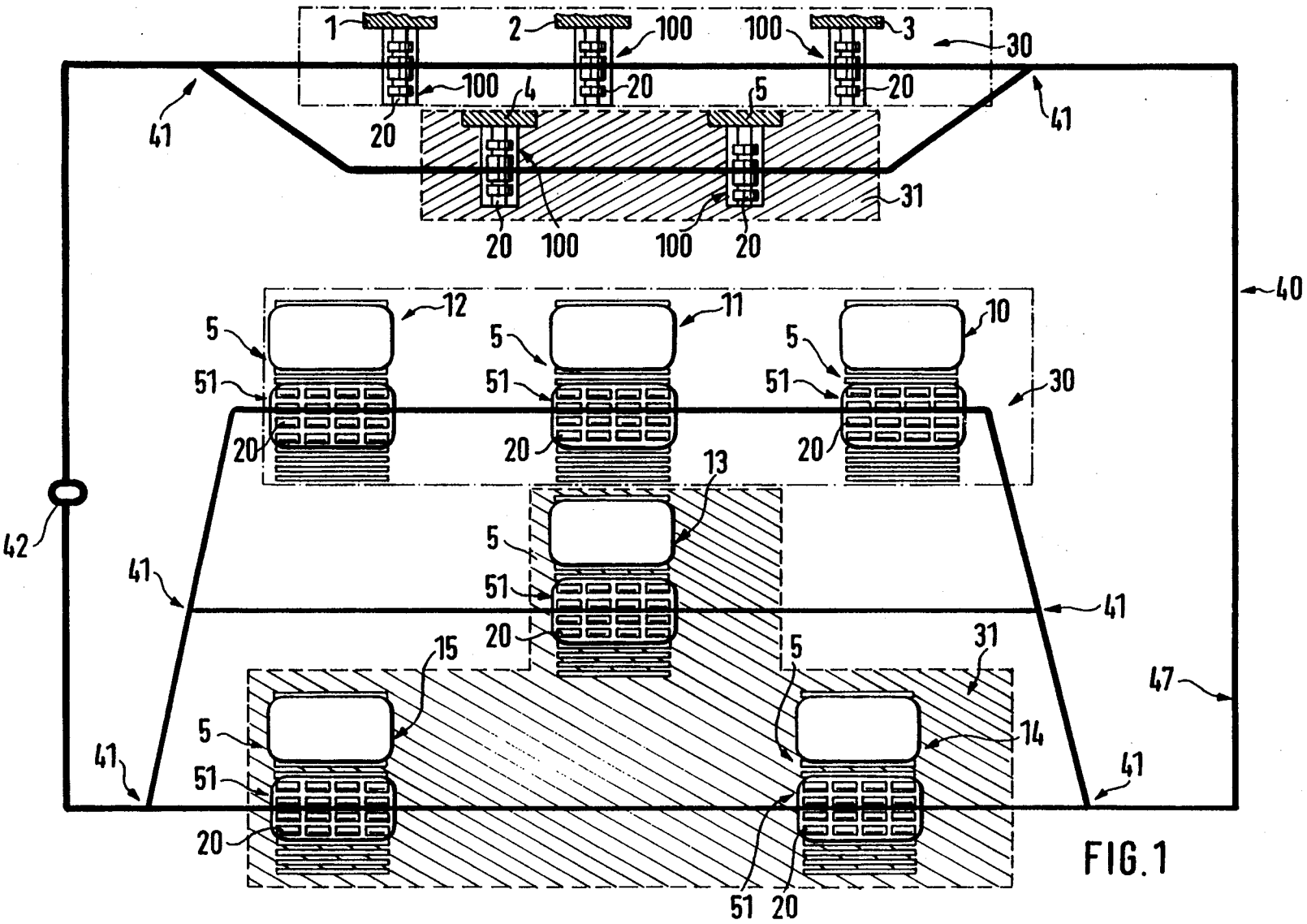
FIGS. 1 and 2 each show a layout of a conveying system according to the invention.

FIG. 1 shows a sketch of a layout of a bobbin conveying system. At sources 1, 2, 3, 4 and 5 bobbins or bobbin-like goods are produced. These sources 1, 2, 3, 4 and 5 may be spinning machines, winding machines or similar machines on which such goods are produced or readied. These goods shall be designated hereinafter as bobbins 20.

The sources 1, 2, 3, 4 and 5 are assigned destinations 10, 11, 12, 13, 14 and 15. These targets can be conveying boxes, small pallets or retaining segments from which the further processing of the bobbins 20 is carried out. The sources as well as the destinations can be assigned to each other in groups 30, 31. This is advantageous if bobbins 20 of different qualities are produced at the sources. The breakdown into groups 30, 31 makes it possible to deposit the bobbins in a sorted-out manner. This means that in the embodiment of FIG. 1 the bobbins 20 which were produced or readied at the sources 1, 2 or 3 are assigned to the destinations 10, 11 or 12. An additional assigning is made in such manner that bobbins 20 from sources 4 or 5 in group 31 are conveyed to the destinations 13, 14 or 15. As the example of group 31 shows, it is often advantageous for a certain number of sources to be assigned several destinations. Thus it is possible that one of the destinations 13, 14 or 15 is prepared for scrap bobbins or that a higher degree of sorting purity is achieved than was presented at the sources. If the destination is prepared for scrap bobbins it will always be reached when bobbins do not meet required quality standards. This ensures that the bobbins are sorted by quality. A different number of sources and destination is also advantageous when a very large number of bobbins 20 are produced at the sources. Due to the fact that a greater number of targets is made available, a target is always sure to be free, even if full bobbin containers are exchanged against empty bobbin containers at other destinations at that same time. The high degree of sorting purity of the bobbins refers to the qualities as well as to the bobbin configurations.

If cylindrical as well as conical bobbins 20 are produced at the different sources, they must be conveyed to different destinations. This also applies to bobbins 20 with different diameters. It is of course also possible to assign fewer destination to a given number of sources. This is advantageous if fewer bobbins 20 are produced at the sources per time unit or when little storage space is available at the destinations and when sorting is effected according to fewer characteristics so that the remaining characteristics of the bobbins 20 are not taken into account in sorting. By gathering together several sources for a few destination, the downstream logistics are advantageously simplified as fewer destinations are to be emptied, in addition to the advantage of smaller space requirements and lower number of devices.

In the sketched layout of FIG. 1 the travelling road 40 is laid out in a substantially circular path in which several switches 41 make bifurcations possible. The travelling road 40 is permanently mounted and suspended off the floor. It is composed of straight and curved segments of a rail 47 which can also be mounted at a slightly rising incline or gradient. It is equally possible to include vertical conveyors into the travelling road system. In an advantageous embodiment, the rails 47 are taken from standard electrically driven trolley systems. Vertical, or also oblique conveyors, make it possible to install the rail 47 in several planes considerations.

The curved segments of the rail 47 can be curved horizontally as well as vertically. By using a building-block approach in designing the travelling road 40, extremely flexible adaptation of the travelling road 40 to a conveying itinerary optimally adapted to the locations of sources and destinations is made possible.

Figure 2:
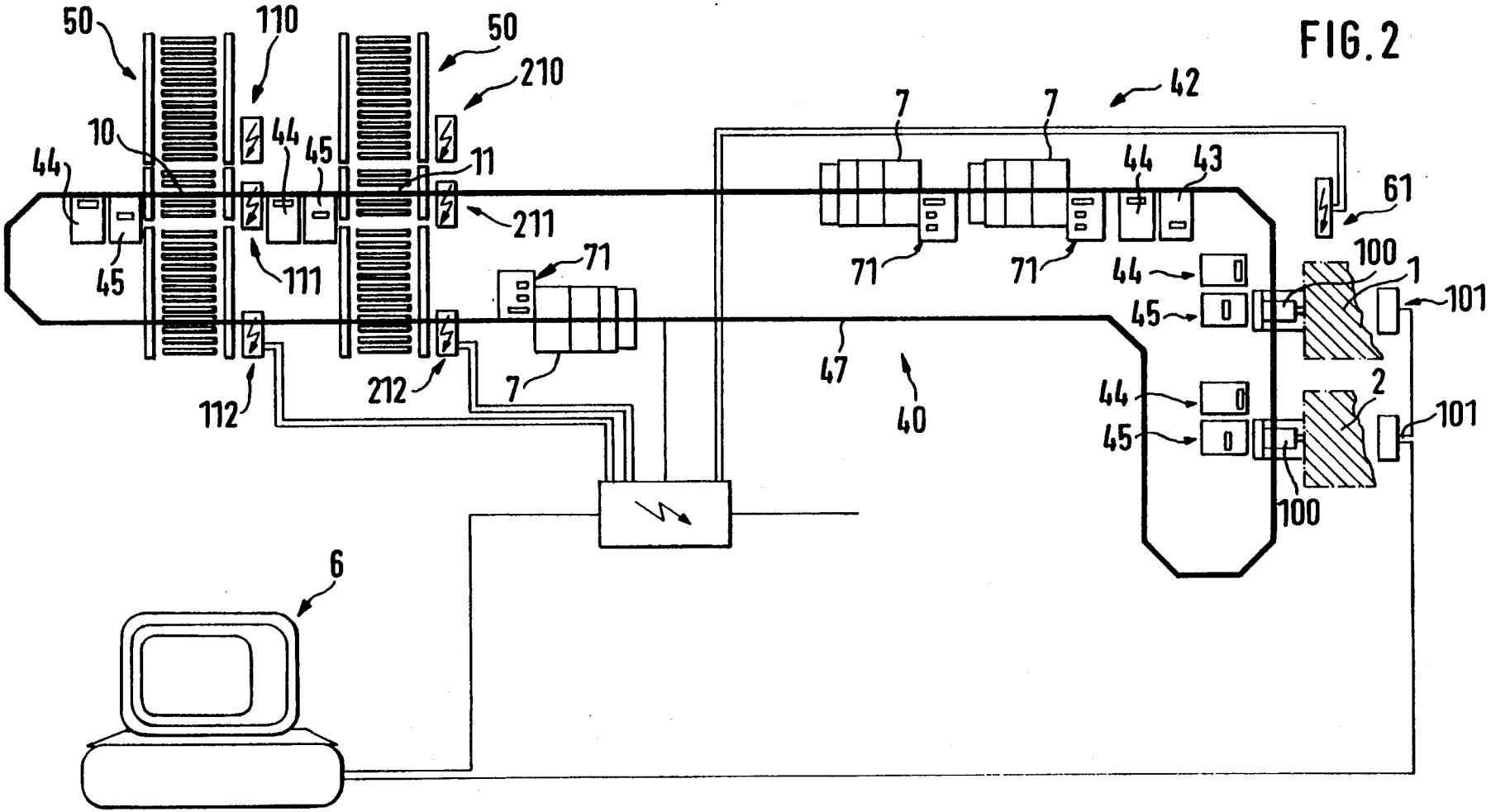

Vehicles 7 (FIG.2) of an electrically driven trolley conveyor stand ready at readiness point 42, awaiting to receive a conveying command. Referring to FIGS. 2 and 3, first vehicle 7 of a row of vehicles 7 of an electrically driven trolley conveyor receives the conveying command transmitted from a central computer 6. The conveying command contains information on the sources and destinations to be reached, on the travelling road with applicable bifurcations to be traveled, as well as on the precise halts of the vehicle 7 at the sources and destinations. As soon as a computing unit 72 of the vehicle 7 has received the order, it begins to carry it out. For this purpose, vehicle 72 travels to the source at which the bobbins 20 are in readiness, takes up the bobbins 20, carries them to the destination provided, deposits them there and travels back to the readiness point 42. Here the vehicle 7 queues up at the back of the line of the vehicles 7 of the electrically driven conveyor trolley. The vehicle is provided with devices by means of which the switches 41 can be switched into the required positions. This switching equipment consists preferably of infrared transmitters which transmit a signal to an infrared receiver located at the switch 41 and which switches the switch 41 into the position required by the conveying vehicle.

The switches 41 of the travelling road 40, just as the readiness point 42, the sources 1, 2, 3, 4 and 5 and the destinations 10, 11, 12, 13, 14 and 15, are recorded in the central computer as salient points of the travelling road 40. When the conveying command is determined, the salient points to be passed are selected and the activity of the vehicle 7 to be carried out at a salient point is written into the conveying command. Thus a determination is made for example, that a switch 41 must be set in a branching-off position, that the source 1 is to be ignored and that a stop is to be made at source 2 for bobbin reception. If the vehicle 7 travels over salient points which are not recorded in the conveying command, the computing unit 72 of the vehicle 7 shows an error through plausibility controls. Depending on the reaction provided for in the conveying command or in the computing unit 72 when an error is found, it is advantageous for the vehicle 7 to move to a section of travelling road on which it is set aside without blocking the other vehicles 7. The vehicle 7 is inspected on such a siding by personnel and the cause of the error is eliminated.

The row of vehicles 7 at the readiness point 42 moves up to the first rank of the readiness point 42 as soon as the foremost vehicle 7 has received its command and has moved out. This advance is triggered by collision-prevention devices installed on the vehicles 7. These collision-prevention devices react to obstacles in front of the vehicles 7. To each of the vehicles 7 standing behind the first vehicle 7, the vehicle 7 standing in front of it is an obstacle, so that these vehicles are prevented from travelling on. The first vehicle 7 is braked by a flag on the rail 47 which can be passed only by receiving the conveying command. The collision-prevention devices are mechanical or electrical proximity switches acting upon the drive of the vehicles 7 and stopping said vehicle 7 in case of an obstacle.

In this embodiment retaining roller conveyors 50 are installed at the destinations 10, 11, 12, 13, 14 and 15. This has the advantage that the conveying containers 51 can be replaced rapidly as soon as they are full. A further advantage consists in the fact that turn tables can easily be built into the retaining roller conveyor 50. This has special advantages when conical bobbins 20 are deposited since the positioning of the bobbin layers in the conveying containers 51 can be programmed with opposing conicity. It is thus possible to turn the conveying containers 51 by 180° as soon as one layer is completely filled with bobbins 20.

The bobbins 20 are readied at the sources to be received by the vehicle in such manner that they come to lie directly beneath a grasping device of the vehicle 7. They are advantageously located on a step-by-step conveyor belt 100 on which the were conveyed to the source. The distance between the bobbins 20 which corresponds to the distance between the graspers of the grasping device depends on the former length, since the formers extending beyond the winding of the bobbins 20 touch each other. The bobbins 20 lie here with part of their circumferential surface on the step-by-step conveyor belt 100. This arrangement of the bobbins 20 has the advantage that the distance between them is the same in every case, independently of the bobbin diameter, without additional devices being required to keep the distances exact.

The travelling road 40 is subdivided into different block sections. The bock sections start for example after a curve and end for example before the next curve. Additional elements within the travelling road 40 at the beginning or at the end of a block section are receiving or depositing positions and switches. The individual block sections can be electrified independently of each other. This prevents the vehicles from coming into the travelling road 40 at critical points when there is a danger of collision. If a vehicle is in a curve for example, the following vehicle cannot enter the curve area at the same time. This prevents the two vehicles 7 from colliding in the area of the curve due to insufficient collision protection. In the area of switches the switching of block sections prevents vehicles from entering an open switch and crashing. The switching of the block sections is effected in such manner that as soon as a vehicle is in a critical block section, the power is switched off from the block section preceding it. The drive of the vehicle 7 is thus stopped until the vehicle 7 ahead has again left the critical block section and the block section of the following vehicle 7 is again given current.

FIG. 2 shows a bobbin conveying system in which the data transmission between the system control and the vehicle 7 is effected by means of infrared rays. The system control is carried out by a central computer 6. At the readiness point 42, the vehicles 7 stand in waiting position and are at first without command. A bobbin conveyor belt at the sources 1 and 2 runs constantly. The source is here assumed to be a rotor spinning machine. The bobbin conveyor belt is merely stopped for bobbin replacement at the different spinning stations and to deposit a full bobbin on the bobbin conveyor belt. The bobbin conveyor belt lets out at the front of the rotor spinning machine into a step-by-step conveyor belt 100. As soon as four bobbins have accumulated on the step-by-step conveyor belt 100 a signal for removal is prepared by the central computer 6. The central computer 6 interrogates the sources in a polling process whether bobbins 20 are ready for removal at the sources. The polling process is a cyclic interrogation of the individual sources to find out whether bobbins 20 are available for removal. The central computer 6 then prepares the conveying requirements message of the rotor spinning machine 1 or 2 in form of appropriate commands issued to the vehicles 7 of the electrically driven conveyor trolley.

Depending on the extent to which a high degree of sorting purity of the bobbins 20 is supervised, the type of material and the quality in which it was reproduced at the different sources is recognized from the configuration entered into the central computer. If sorting is required to reach a higher degree of purity, the information concerning the different bobbins is gathered at the sources and transmitted to the central computer 6. There the conveying command is developed as a function of the degree of sorting purity. When the bobbins at the sources have been detected by the central computer 6, the best-suited destination is determined by the central computer 6. The determination of the destination depends on quality, e.g. the type of bobbin, as well as on the shortest and thereby quickest possible travel route. In the embodiment of FIG. 2, as an example, two sources 1 and 2 are assigned to the two destinations 10 and 11. The two destinations 10 and 11 include retaining roller conveyors 50 in which empty conveying containers are brought in on a turn table from one side and where the full conveying containers are removed on the other side of the retaining roller conveyor. The sensors 110, 111, 112 or 210, 211, 212 are installed on the retaining roller conveyors 50. The sensors 110 or 210 recognize whether empty conveying containers are available. If this is not the case, the respective destination involved cannot be considered in a conveying command as soon as the present conveying conveyor is filled. The sensors 111 or 211 are located at the turn tables of the retaining roller conveyors 50. They monitor the position of the turn table. If a layer in the conveying container is completely filled when conical bobbins are deposited in conveying containers with several layers of bobbins 20 on top of each other, the turn table is rotated by 180°. In this way uniform filling of the conveying container with conical bobbins is achieved. The sensors 112 or 212 recognize whether the retaining roller conveyors 50 have additional acceptance capacity for full conveying containers. If full conveying containers are present at the sensors 112 or 212, the destination stipulated in a conveying command can no longer be taken into account. Only when the accumulated, full conveying containers have been removed from the retaining roller conveyors 50 is it possible for these buffer zones to accept additional full conveying containers.

As soon as a suitable destination has been determined by the central computer 6, the next position to be occupied is determined for the conveying container. The position is advantageously modeled after a set filling model which shall be described in greater detail through FIGS. 4 and 15. This determination of the next position has the advantage that only the stop position of the vehicle 7 must be altered, and the conveying container need not be moved into different positions. In the conveying command the central computer 6 furthermore determines the direction in which conical bobbins 20 are to be deposited. As described above, this depends on the layer of conical bobbins 20 upon which the new layer of conical bobbins 20 is to be deposited. If two bobbin layers with opposing conicity lie on top of each other, this results in an essentially vertical stacking of the bobbins 20. Depending on the design of the bobbin conveying system, the turn tables are then moved into the proper position or a determination is made in the order as to the direction in which the conical bobbins are to be oriented at the vehicle 7.

Once the destination has been assigned to the source, the data set for the conveying command of vehicle 7 is assembled. The data is then transmitted by the central computer 6 to the vehicle 7. In this embodiment, this is effected via an infrared transmitter 61. An infrared receiver is installed on the vehicle 7 to transmit the data to a computing unit 72 of the vehicle 7. The data represents an internal itinerary of vehicle 7. When the command has been accepted in the computing unit 72, vehicle 7 starts up and, at each position of the travelling road 40 at which a decision must be made, compares that actual position with the internal itinerary. Based on this orientation of vehicle 7, the reaction of the vehicle is decided. A reaction consists either in the reception of the bobbins 20, in the depositing of the bobbins 20, or in a switching of a switch.

Three different types of flags are fixedly installed on the rail 47. These are synchronization flags 43, counting flags 44 and zero flags 45. Initiators 71 are installed on the vehicle 7. These initiators 71 address the flags 43, 44 or 45. The vehicle 7 travels first over the synchronization flag 43. This resets all the counters in the vehicle to zero. In this manner travel to wrong sources or destinations is avoided. One counting flag 44 and one zero flag 45 is installed before each source 1 or 2 and before each destination 10 or 11. The vehicle 7 travels over these flags insofar as said vehicle 7 is not at the source or at the corresponding destination which is relevant to carry out the command. If the vehicle 7 has arrived at the source indicated in the command and travels over the counting flag 44, a signal causing a reduction of the traveling speed is transmitted via the initiator 71 to the drive of vehicle 7. This ensures advantageously that the length of brake path is so short at the reduced travelling speed that the relevant position can be reached precisely. When the counting flag 44 has been reached the zero flag 45 is then reached at the reduced traveling speed. If the vehicle 7 is at a source 1 or 2 at which the receiving position occurs in every instance at the same location, the vehicle halts precisely at the zero flag 45. Grasping devices which are lowered to the level of the prepared bobbins 20 are installed on the vehicle 7. The grasping devices seize the prepared bobbins 20 and lift them to an overhead level. As soon as the grasping device is again at the level of the vehicle 7 said vehicle travels on at maximum speed to the depositing location provided for. If switches 41 are provided in the travelling road, the momentary position of the vehicle 7 is recorded via the initiators and is evaluated by the computing unit 72 on the vehicle 7. If the switch 41 is not in the position needed it is switched through a signal emitted by the vehicle 7. If the vehicle 7 has arrived at the selected destination 10 or 11 it again travels over a counting flag 44, causing the conveying speed to be reduced. Following this the zero flag 45 is passed. Since the exact position of deposit into the conveying container can vary when the bobbins 20 are deposited, the precise distance between the depositing position and the zero flag 45 was determined in the conveying command. An incremental counter installed on the vehicle 7 counts the revolution of one of the bearing rollers of the vehicle and thus ascertains the precise distance traveled. If the preset distance has been traveled the vehicle 7 is stopped. The grasping device with the bobbins is lowered, the grasping device detaches itself from the bobbins and is then lifted back to the level of the vehicle 7. When the vehicle 7 has executed the command it returns to the readiness point 42 and waits there for a new command.

If it has been determined by the initiators 71 on the vehicle 7 that the positions passed do not match the internal command or that bobbins 20 cannot be received or deposited or that other errors have occurred in carrying out the conveying command, it is advantageous to provide a siding in the layout of the conveying system into which the vehicle moves. This ensures that other vehicles 7 are not hindered in carrying out their commands. The vehicle 7 in which an error has occurred can then be inspected by a person and the cause of the error can be sought.

The number of required vehicles per conveying system depends on the number of bobbins 20 produced per time unit and on the length of the travelling road. In plants with 10 rotor spinning machines, 2 to 5 vehicles generally yield an optimal ratio, making it possible to achieve punctual emptying of the machines and to achieve the highest degree of efficiency.

If the vehicle 7 has arrived at its readiness point 42 it is acquitted of its command in the central computer 6. The vehicle 7 is thereby freed for a subsequent command.

The intelligence available through the computing unit 72 on the vehicle 7 makes it possible to exert destination control. This means that a destination is given to the vehicle 7 and that it autonomously clears the way to this destination. The travelling road 40 is divided into block sections. These block sections are segments in which the different vehicles 7 cannot pass each other. If a malfunction occurs in one of the vehicles 7, making it impossible for said vehicle 7 to continue its travel, an electrical signal is emitted on this segment of the travelling road 40 and is evaluated by the central computer 6 and is taken into account in new commands. Other vehicles 7 are thus unable to enter this blocked section and they must go around the closed block section.

The initiators 71 of the vehicle 7 are triggered by the flags 43, 44 and 45. While one initiator 71 is assigned to the synchronization flag 43 and one to the zero flag 45, two initiators are provided for the counting flag 44. When passing the synchronization flag, all the counters on the vehicle 7 are set to zero. The zero flag 45 resets the distance measure to value zero and thus causes the distance covered by the vehicle 7 from the zero flag 45 on to be measured. The counting flag 44 advances a counter in the computing unit 72 of the vehicle 7 by value "1". Thereby the number of critical points in the travelling road 40 which are passed are counted in the computing unit 72. Counting flags 44 are placed at those points of the travelling road 40 at which decisions must be made. While a decision is made at the sources and at the destinations whether the vehicle should stop or continue its travel, the switch position is decided at the switches. The type of action desired and the selection of the counted critical point passed at which it is to be carried out by the vehicle 7 is accordingly determined in the conveying command. It is therefore important for faultless and reliable operation of the bobbin conveying system that the counting carried out by the counting flags 44 is correct. For that reason two initiators 71 are installed on the vehicle for the acquisition of the counting flags 44. The two initiators 71 are connected to each other in such manner that the computing unit 72 recognizes whether the vehicle 7 has passed several counting flags 44, or whether these same counting flags 44 may have transmitted several counting impulses to the initiators 71 due to vibrations, for example. In case of vibration it is possible that the initiators 71 may pass the same counting flag 44 several times, going forward and back. The circuits of the two initiators 71 now cause counter to be advanced by one, if the counting flag 44 is passed in forward motion, while passing in reverse causes the counter to be set back by one. Thus the counting flag 44 is only counted once.

The utilization of the flags 43, 44 and 45 advantageously cause the vehicle 7 to be actively controlled through the computing device 72 by this simple, passive component. This offers the special advantage that the bobbin conveying system is extremely flexible with respect to the installation of sources and destinations. New sources and destination can be integrated into existing installations at low cost, by adding additional counting flags 44, without having to modify active components which are complicated by comparison with the flags.

The optical data transmission from the central computer 6 to the vehicles 7 by means of infrared rays is shown in FIG. 3. For this purpose the system controls are subdivided into a mobile part and into a stationary part of the system controls. The mobile part of the system controls is the computing unit 72 on each of the different vehicles 7. The stationary part of the system control is the central computer 6. The available sources and destinations as well as the bobbin qualities at the different sources or destinations, are entered via the central computer 6, which may be a personal computer. It is possible that completely different conveying goods are made available at the different sources. Through the conveying system according to the invention it is now possible to unload winding and rotor spinning machines with a common conveying system. The destinations must also be defined accordingly in different manner. Thanks to this flexible system it is also advantageously possible for the sources with frequently changing qualities to be newly defined through the personal computer. New parameters of sources and destinations is effected through the personal computers. The data for conversion into usable signals is prepared through bus module 82. Data transmission takes place in the full duplex process, i.e. data can be received and transmitted by the mobile as well as by the stationary part of the controls.

An infrared transmitter and an infrared receiver 61 are installed in the stationary part of the system control as well as in the mobile part of the system control. The infrared transmitter 61 of the stationary part communicates with the infrared receiver 62 of the mobile part of the system control. The opposite applies for data transmission from the mobile part to the stationary part of the system control. Thus an infrared transmitter 61 and an infrared receiver 62 are installed in the mobile part as well as in the stationary part. Data is transmitted at up to 200 meters distance. The signals received in the mobile part of the system control, i.e. on the vehicle 7 via the infrared receiver 62, are retransmitted to controls with programmable memory in the vehicle 7. This programmable-memory control is the computing unit 72 of the vehicle 7. The variable parameters of the stored program are covered by the signals received. The information pertaining to receiving points and points of deposit as well as the switching positions of the switches required to carry out an individual command are determined in these parameters. This makes it possible for the vehicle 7 to carry out commands with precision.

The controls 81 with programmable memory of the stationary part of the system control can be located at the destinations, for example. The position of the turn tables is controlled through these controls 81 with programmable memories when using retaining roller conveyors. As a function of the command to be issued, the central computer 6 influences these controls 81 with programmable memory as well as the controls 72 with programmable memory of the mobile part of the system control. The difference between the controls with programmable memory constituting the computing unit 72 of the mobile part and the controls 81 with programmable memory of the stationary part of the system control consists in the possibility of data transmission. While the transmission to the mobile part must be flexible, it is advantageous and less expensive for data transmission to the controls 81 with programmable memory of the stationary part to be effected via circuits.

FIG. 4 shows an advantageous alternative of the optical data transmission by means of infrared rays. The central computer 6 is connected to controls 81 with programmable memory just as in FIG. 3. Bus modules 82 are provided at nodal points. Signal transmission in the embodiment according to FIG. 4 is not effected by means of infrared rays as in the embodiment according to FIG. 3, but through sliding contacts 73 and live rail 46. An electronic signal converter 83 is located between the central computer 6 and the live rail 46. This signal converter 83 prepares the data so that the central computer 6 is able to communicate with all the mobile controls. The live rails 46 are tapped by the different mobile controls or vehicles 7 via sliding contacts 73.

The signals thus tapped by the sliding contacts 73 on the live rail 46 are converted in the signal converter 83 on the mobile control into a signal that can be used by the control with programmable memory or the computing unit 72 of the vehicle 7. Signal converter 83 is provided on each individual vehicle 7 so that the signals especially destined to that particular vehicle 7 can be recognized.

The embodiment according to FIG. 4 has the advantage over the embodiment according to FIG. 3 that the central computer 6 is able at all times to communicate with the different computing units 72 of the mobile controls. In the embodiment according to FIG. 3 this is only possible within the area that can be reached by the infrared transmitter 61 of the central computer 6. The embodiment of FIG. 4 offers special advantages in case of an error in the mobile or stationary elements of the system. It has furthermore advantages with respect to readiness point 42. While several readiness points 42 can be installed without additional expense in the embodiment according to FIG. 4 so that even distribution of vehicles 7 is possible over the entire conveying system, additional infrared transmitting stations would have to be installed in the embodiment according to FIG. 3. The even distribution of vehicles 7 over the entire conveying system has the advantage, especially with large conveying systems, that the routes by which the vehicles reach the different sources can be kept very short.

FIG. 5 shows a vehicle 7 on a rail 47. The rail 47 is advantageously a rail for electrically driven conveyor trolleys in accordance with VDI guide-line 3643/C1.

The drive unit 74 and the running gear 75 are also components known in electrically driven conveyor trolley systems. Sliding circuits for current and data transmission are provided on the rail 47 in a known manner. These sliding circuits are not shown in FIG. 5. The running gear 75 which, depending on the length of the vehicle 7, consists of two or more bearing rollers as well as of several lateral support rollers supporting the suspension tackle 76 at lower holding points. The suspension tackle 76 consists essentially of the elements needed to produce compressed air and of those for the control and the handling of the bobbins. The computing unit 72 is installed in a switch box 310 on the suspension tackle 76 to control the vehicle 7. The control with programmable memory and, depending on the embodiment, the signal converter 83 are installed in the switch box 310. If data transmission is optical through infrared rays, the computing unit 72 receives its signals via an infrared receiver 62 mounted on housing 76. The infrared transmitter 61 is also mounted on the suspension tackle 76 in order to transmit the data from the computing unit 72 to the central computer 8. The installation of the infrared receiver and transmitter 61, 62 on the suspension tackle 76 has the advantage that the area under the rail 47 is least encumbered with obstacles. For optical data transmission a sight connection is necessary between transmitter and receiver in order to ensure data transmission. The area above the rails 47 is generally encumbered by the holding points of the rails 47 which represent obstacles for the sight connection. If the rails 47 are supported with supports on the floor, a placement on the vehicle 7 above the rail 47 is better since the obstacles below the rail 47 are then more frequent. An initiator 71 is furthermore provided on the running gear 75. Switching flags provided on the rail 47 are registered by the initiator 71. The initiator 71 is connected to the computing unit 72 in the switch box.

The running gears 75 are articulately connected to the tie-bar 300 of the suspension tackle 76. This ensures that travel is possible on horizontal as well as vertical curves of the rail 47. The suspension tackle 76 is attached rigidly to the tie-bar 300. Essentially, the compressor with the pressure container 320, as well as the handling device 330, are installed next to the switch box 310. The pressure container 320 is attached to a supporting device 321. The drive (not shown in FIG. 5) of the handling device 330 as well as the compressor are attached on the supporting device. The handling device 330 consists advantageously of several pairs of graspers 332 installed at a right angle to the direction of travel of the vehicle 7. The arrangement at a right angle to the direction of travel advantageously ensures that reception and deposit of the bobbins are carried out with very little expenditures tied to the installation of the receiving and depositing frames. An extremely economical and flexible conveying system is thus achieved. A further advantage consists in the short structural length of the vehicle 7 which can thus be achieved. Since the length of the vehicle 7 has a direct influence on the minimum radia of the rails 47, a shorter length of the vehicle 7 is advantageous. The shorter the vehicle 7 or the tie-bar 300, the narrower are the curves that can be provided and the easier is it to adapt to the building or system layouts. If the length of the vehicle exceeds a maximum value, the suspension tackle 76 must be articulated, and this causes loss of stability which must be compensated by additional running gears 75. The placement of the handling device 330 at a right angle to the direction of travel furthermore ensures that flexible adaptation of the number of graspers 332 is possible without modifying the suspension tackle 76. It is thus possible to equip vehicles with three, four or five pairs of graspers 332 for example, without significant additional costs. It has however proven to be advantageous to provide four pairs of graspers 332 in the handling device. This number has been found to be advantageous with the frequent use of standardized conveying containers in which the bobbins are to be deposited. These are designed so that four bobbins 20 fit in width into one row in the conveying containers.

The graspers 332 are articulately connected to each other in such manner that they can be moved in form of a parallelogram. In this way no relative movement can affect the bobbins. This makes it possible to handle the bobbins with great care since the graspers are always standing vertically with such positioning and do not reach under the bobbin via a rotational movement. If the bobbins were to be grasped from underneath, this would pull on the individual yarn windings and subject them to wear. A further advantage in such a movement of the graspers consists in the extremely low lateral space requirement for the graspers 332 as they grasp and release the bobbins. This has its effect especially with the conveying containers in which the packing density of the bobbins should be very great. If the graspers were to move out far as they release the bobbins, the distance to the conveying container wall or to the next bobbin would have to be very great if contact between the graspers 332 and the adjoining bobbin were to be avoided.

The graspers 332 are pneumatically actuated. The grasping force of the graspers 332 can be adjusted in function of the pneumatic pressure. This ensures that bobbins with low bobbin density are taken up with less grasping force and that damage to them is thus avoided.

The grasping devices are placed so that the bobbins are seized at their circumference. The axes of the bobbins are essentially horizontal and perpendicular to the conveying direction. This leads to the advantage that great packing density is achieved in the conveying containers on the one hand, and on the other hand that the bobbins need to be rotated only very minimally. Due to the fact that the bobbins are delivered to the receiving point in the same position in which they must come to lie in the conveying container, they need not be seized repeatedly by devices and turned in the direction wanted at the moment. This makes it possible to handle the bobbins advantageously in a gentle manner and with little danger of damaging them.

The handling device consists of individual grasping devices with a pair of graspers 332 provided for each grasping device. In this way each individual bobbin can be seized separately by a pair of graspers 332. Depending on the degree of sorting purity to be achieved at the depositing location it is now possible to make all the grasping devices of a handling device so as to be capable of being actuated together or independently of each other. If very fine sorting is to be achieved it is advantageous for each individual grasping device to be capable of being actuated individually. This affords the possibility of conveying individual bobbins which do not belong to the other bobbins of a conveying command because of their different type to be conveyed to other destinations. If no such very fine sorting is required, or if the bobbins are already sorted when they arrive at the receiving point, all the graspers 332 of a vehicle 7 are opened and closed simultaneously. This possibility leads to lower control costs and also to lower mechanical costs.

The force needed to grasp the bobbins as a function of bobbin density can be adjusted through a valve for the regulation of the air pressure on the grasping devices. It is just as important to regulate the grasping speed of the grasping devices as their grasping force in order to ensure that the bobbins are seized gently by the grasping devices. A reduction of the grasping speed of the grasping device is effected through a choke for the regulation of the air pressure supplied by the compressor 325. The lower the grasping speed of the grasping device in seizing the bobbin, the gentler the bobbin is seized, since the graspers 332 are braked by the winding of the bobbin and since the load on the winding is therefore less at lower speed than at higher speed.

Independently of the grasping force and the grasping speed of the grasping device, it is possible to grasp bobbins of different diameters by means of the grasping device shown in FIG. 5. Due to the placement of the grasping devices next to each other in direction of travel and in such manner that the bobbin axes are lined up essentially perpendicularly to the direction of travel and are aligned with each other, i.e. transversely to the direction of travel, the distance between the bobbins is always constant. This means that bobbins of different bobbin diameters have the same lateral space requirement. The maximum bobbin diameter is merely limited by the maximum grasping reach of the graspers 332, but not by the distance between the grasping devices.

The switch box 310 is advantageously installed at the end of the vehicle 7. It is closed by a cover 311. Thanks to its low location, the switch box 310 is easily accessible for maintenance work. By being hinged, the cover 311 ensures unhindered access to the computing unit 72 or to the controls with programmable memory. A coupling 312 is furthermore provided on the switch box 310. Via this coupling it is possible to connect manual controls to the vehicle 7. The manual controls ensure that the sources can be emptied by manual control in case of malfunction of the computer 6, for example. Manual control is also advantageous when a vehicle 7 must be checked for operational capability or when a defective vehicle is to be taken out of the travelling road 40. The movements of the vehicle 7 as well as the movements of the graspers 332 or the lowering of the handling device 330 are controlled manually when manual control is used.

The drive unit 74 is used for the movement of the vehicle 7. The motor 741 is connected via a gearing 742 to a drive roller which rolls on the rail 47. Manual pushing is possible via a mechanical coupling on the gearing 742. In case of power or control failure on the vehicle 7, the operating personnel is able to push the vehicle 7 manually on a siding by actuating the mechanical coupling. The main path of the system is not blocked thanks to the siding, and bobbin conveying by the remaining vehicles 7 can thus continue unhindered.

Switch flags are provided along the travelling roads to actuate the receiving points and points of deposit. Two flags are provided for each halting point. At the first flag the motor speed is lowered from fast to slow. The second flag causes the distance previously set by the central computer 6 to be measured up to the halting point. An incremental measuring device 751 located on the non-driven roller of the undercarriage 5 is provided for precise distance measuring. The incremental measuring device 751 counts the revolutions of the non-driven roller, and thereby finds the distance covered. Due to the fact that the roller is not driven, it rolls essentially without slippage. This makes it possible to measure the distance with great precision. The distance measure is transmitted to the computing unit 72, and when the required distance has been reached, this causes a signal to be transmitted to the motor 741 so that it may stop the vehicle 7.

The pressure container 320 is connected to the handling device 330 via helicoidal compressed air hoses 322. The helicoidal compressed air hoses 332 prevent advantageously blockage of said compressed air hoses 322 when the handling device 330 moves. Furthermore the helicoidal compressed air hoses 322 do not hang below the lowest edge of the vehicle 7 when the handling device 330 is in rest position. Thereby any danger of the compressed air hoses becoming caught during the travel of the vehicle 7 is prevented. In order to achieve space saving attachment of the handling device 330 to the suspension tackle 76, the helicoidal compressed air hoses 322 are attached to the handling device 330 via a rocking bar 323. The compressed air hoses 322 let out into the rocking bar 323 which is in turn attached in the articulation 324 at the top of the handling device 330. In lifted position of the handling device 330 the rocking bar is closed flat against the top of the handling device 330. When the handling device 330 is in extended position, the rocking bar 323 is brought via articulation 324 into a closed-up position. This ensures that no additional lateral space is required when the bobbins are deposited in the conveying container. In this manner high packing density of the bobbins in the conveying container is ensured.

To receive conical bobbins, the graspers 332 are arranged around a vertical axis in such manner as to be capable of being rotated. This ensures that the graspers 332 grasp the bobbins over as large a surface as possible. Thereby it is possible to keep the surface pressure on the winding of the bobbins to a minimum. The excursion of the graspers 332 makes it possible for the sensors to detect the conicity orientation of the grasped bobbin. If a design with individually rotatable pairs of graspers 332 are used on the vehicle 7, the conical bobbins can be oriented in one and the same direction on basis of this signal.

If the sorting of the conical bobbins in identical orientation was already carried out by a device at the receiving point it is possible, in an embodiment which is not further represented here, for all the pairs of graspers 332 to rotate around a vertical axis of the handling device 330, causing the conical bobbins to be re-oriented. This makes it possible to dispense with turn tables at the destinations since the correct orientation of the bobbins, depending on their position in the conveying containers, has already been assumed in the vehicle 7.

If the distance between bobbins is not sufficient, it is necessary to achieve sufficient distance between them to be able to rotate the individual bobbins. This is made possible by means of a telescope-like widening causing the handling device 330 to move apart. For conveying it is advantageous to move the bobbins until they are at a minimum distance from each other. This increases the traveling stability of the vehicle and furthermore decreases the lateral space requirement of said vehicle to a minimum.

FIG. 6 shows a top view of the suspension tackle 76 detached from the undercarriage.

A motor 340 is installed on a supporting device 321. The level of the handling device 330 is changed by means of this motor 340. The motor 340 is preferably a shift anchor motor which is braked in a voltage-less state. A compression spring then shifts the motor axle on which the rotor and the brake are fixedly mounted. If voltage no longer reaches the motor the brake is pressed into brake shoes. This ensures that the handling device is fixed at the level at which it is at the moment in case of power failure. This eliminates the danger of the handling device 330 dropping suddenly in case of power failure, possibly causing injury to personnel. It furthermore offers the advantage that a mechanical immobilization is achieved when the handling device 330 is in its uppermost position. This makes it possible not to supply the motor 340 with current during the conveying process. Following the motor 340, a gearing 341 is installed on the supporting device 331. The gearing 341 serves to multiply or to reduce the r.p.m.'s of the motor to the desired rotational speed of a roller 334. A coupling 342 is located between the gearing 341 and the handling device 330. This coupling facilitates assembly and adjustment since it makes it possible to compensate for slight axial offsets. If excessive forces act upon the handling device 330, the coupling 342 acts as a protection of the motor 340 and of the drive 341. Excessive forces can act upon the handling device 330 when it becomes snagged as it hoists objects, for instance.

An incremental measuring device 343 is installed on the shaft going from the coupling 342 to the handling device 330. This incremental measuring device 343 measures the actual rotation of the hoisting device 333. This is advantageous in order to achieve precise measurement of the level of the graspers 332 at a given moment. A flexible band on which the graspers 332 are attached on a frame is wound up on the roller 334 of the hoisting device 333. The flexible band is very wide by comparison to its thickness, thereby ensuring suspension of the graspers 332 with little oscillation. The flexible band is attached on the roller 334. It is placed so that it is led over the two deflection rollers 335. When the roller 334 rotates, the two parts of the flexible band are either rolled up or unrolled. This produces an ascending or descending movement of the graspers 332.

The incremental measuring device 334 consists of an impeller wheel made of metal and of an induction measuring device. As soon as a wing moves past the induction measuring device, a signal is recorded. The more wings are provided on the impeller wheel, the more precision is possible in measuring the partial revolutions of the shaft. The actual level of the graspers is calculated from the circumference of the roller 334 and the thickness of the flexible band, together with the number of revolutions.

FIG. 7 shows the section A—A from FIG. 6. In this side view the housing 76 is shown without graspers 332 and without switch box 310. In this embodiment the operating units motor 340, gearing 341, coupling 342 and roller 334 are preferably installed below the tie-bar 300. This ensures that the vehicle 7 is not hindered in its travel by narrow vertical curves. The structural height of the running gear 75 can then be kept very low, so that standard construction components according to VDI Guideline 3643/C1 can be used. In the drawing of FIG. 7, shock absorbers 344 can easily be recognized. The shock absorbers 344 enable the graspers 332 to go gently into their end position. Another advantage of the shock absorbers 344 consists in the fact that the graspers 332 are always in a slightly pre-stressed state in the upper position. This prevents swinging of the graspers at arrival of the vehicle 7, when it is going through curves or when it is braked. The shock absorbers 344 are preferably located at the four corners of the supporting device of the graspers 332. This makes it possible to optimally achieve the required characteristics. Spring absorber systems of a different type are of course also possible, making it possible to achieve a pre-stressed and guided end position of the handling device 330.

In the embodiment shown in FIG. 7 the pressure container 320 is located underneath the supporting device 331. The compressor 325 is located next to the motor 340 on the supporting device 321. The placement of motor 340, compressor 325 and handling device 330 can vary with different embodiments of the vehicle 7. The arrangement depends on the weights of the components used. Care must however always be taken that the distribution of weight on the vehicle 7 is as even as possible. This ensures reliable travel operation of the electrically driven conveyor trolley.

A valve 323 is provided on the supporting device 331. The air pressure coming from the compressor 325 and acting on the graspers 332 can be regulated through the valve 323. By changing the air pressure the force with which the bobbins are grasped can be varies. This is advantageous for the adjustment of the force in function of winding density. A choke 322 makes it possible to regulate the grasping speed of the grasping device directed at the bobbins. The air pressure of the compressor 325 which acts upon the grasping device can be adjusted through the choke 322.

FIG. 8 shows the cross-section B—B of FIG. 6. The compressor 320 is installed on the supporting device 331, perpendicularly to the direction of travel. The gearing 341 is attached on the supporting device 331. The incremental measuring device 343 is located on the coupling 342. The incremental measuring device 343 consists of an incremental measuring device (not shown) and of an incremental indicator. The incremental indicator consists of an impeller wheel. The impeller wheel in this embodiment has four wings. With it, a measuring precision of $\frac{1}{4}$ revolution of the shaft driving the roller 334 is achieved. It is of course also possible to provide an impeller wheel with a greater number of wings, achieving greater measuring precision.

The supporting device 331 is attached to a base support 301. The base support 301 ensures stable attachment of the different devices needed to carry out the conveying command. Furthermore the base support 301 makes it possible to arrange the individual components in a clearly visible and therefore assembly-friendly arrangement of the individual components. The base support 301 is attached over centered suspension points on the tie-bar 300. The tie-bar 300 represents the interface with the commercially obtainable elements of an electrically driven conveyor trolley.

FIG. 9 shows the section C-C of FIG. 6. The section C—C shows the hoisting device 333 more precisely. The roller 334 and the deflection rollers 335 are mounted on a supporting device perpendicularly to the base support 301. A synthetic-material band 337 is wound up and unwound on the roller 334. FIG. 9 shows the roller 334 in an unwound state. The placement of the synthetic-material band 337 on the roller 334 is such that both sides are rolled up and are unrolled uniformly. This ensures an even rising and descending movement of the handling device 330 attached to the synthetic-material band 337.

A deflection roller 335 is mounted so as to be capable of vertical movement. If the synthetic-material band 337 is loaded, i.e. if the handling device 330 hangs freely from the synthetic-material bands 337, the vertically movable deflection roller 335 is pushed down into its lowest position. As soon as the handling device 330 meets an obstacle in its downward movement, so that the synthetic-material band 337 is discharged, the vertically movable deflection roller 335 moves into its upper position and thereby actuates an unloading switch 336. The unloading switch 336 brings the motor 340 to an immediate stop. This advantageously ensures the lowering of the handling device 330 at the receiving station to the level of the ready bobbins and automatic stopping of said handling device 330 at the level of the last layer in the conveying container at the depositing of the conveyed bobbins.

In case of a failure of the unloading switch 338, or in case that the depositing or receiving points are lower than the lowest possible lowering of the handling device 330, a metal form 330 is provided in the end zone of the synthetic-material band 337. As soon as the roller 334 is nearly unwound, the metal form 338 moves past a sensor 339, causing a signal for the stopping of the motor 340 to be produced. The metal form 338 is advantageously a metal rivet incorporated into the synthetic-material band 337. This has the advantage that it does not jut out far when the synthetic-material band 337 is wound up on the roller 334 so that damage to the synthetic-material band 337 wound over the metal form 338 is avoided.

If the deflection roller 335 is moved into position 335 at the unloading of the synthetic-material band 337, the unloading switch 336 is unloaded and transmits a signal to the motor 340. The signal stops the motor 340. Renewed start-up of the motor 340 is controlled via the computing unit 72. The unloading switch 336 has therefore exclusively the function of switching off the motor 340, and not the function of switching it on.

FIG. 10 shows the section D—D of FIG. 6. From this, the manner in which the vertically movable deflection roller 335 is supported can be seen. The axle of the deflection roller 335 is connected at both ends to traction springs 345. The traction springs 345 cause the deflection roller 335 to be moved in its unloaded state to an upper position. This disengages the unloading switch 336. The traction springs 345 are designed so that when the handling device 330 is unloaded, the deflection roller 335 moves very rapidly into the upper position. This ensures rapid switching-off of the motor 340.

FIGS. 11 to 13 show a vehicle 7 in different situations during the conveying process. FIG. 11 shows the vehicle 7 at a source. The handling device 330 is lowered to the level of the bobbins 20. The graspers 332 enclose the bobbins 20 at their circumference.

The graspers 332 are actuated by means of compressed-air cylinders. For this reason the compressed-air hose 322 leads from the compressor 320 to the handling device 330. The rocking bar 323 is here slightly inclined upward. The synthetic-material band 337 is partly unrolled from roller 34. As soon as the graspers 332 have arrived at the level of bobbin 20 and make contact with a bobbin layer, the unloading switch 336 located on one deflection roller 335 reacts and stops the motor. A signal is then transmitted from the computing unit 72 to actuate the compressed-air cylinders on the handling device 33 and thereby to close the graspers 332. As soon as the bobbins 20 have been seized by the graspers 332 the motor 340 is started up again and winds the synthetic-material band 337 up on the roller 334. This moves the handling device 320 into the position shown in FIG. 12.

If the handling device 330 is in its upper position as shown in FIG. 12, the vehicle 7 is in a travel-ready state. In this position the vehicle 7 carries out the rest of the conveying command. In doing so it travels from the source indicated in the conveying command to the predetermined destination. In the position shown in FIG. 12, the handling device 330 is in its most stable position. It is furthermore ensured in this position that structural height of the vehicle 7 reaching the lower edge of the rail 47 is minimal. This decreases the risk of a collision with obstacles.

FIG. 13 shows the vehicle 7 at a destination 10. The handling device 330 is located in a conveying container 51. The graspers 332 still encircle the bobbins 20. As a next step, the pneumatic cylinders of the handling device 330 are brought into a pressure-free position. The graspers 332 are not subjected to compressed air in this case, so that the graspers 332 essentially exert no force on the bobbins 20. The articulated installation of the graspers 332 ensures that lateral space requirements for the grasper 332 are minimal as it opens. When the graspers 332 are without pressure, the synthetic-material band 337 is wound up on the roller 334. Favored by the configuration of the graspers, said graspers 332 slide flatly past the bobbins 20, without touching the adjoining bobbins 20. The advantageous arrangement of the synthetic-material bands 337 stands out especially with such long lifting paths of the handling device 330. The two synthetic-material bands 337 are located on the side, next to the rail 47, on the suspension tackle 76. In an advantageous embodiment the width of the synthetic-material band 337 is approximately 10 cm. Oscillation of the handling device 330 during descent and ascent is thereby avoided. The utilization of only two synthetic-material bands 337 is very advantageous because of the low technical cost, especially since only one wind-up device 332 is required for stable operation of the handling device 330.

The compressor 325 supplies compressed air for the graspers 332. In this embodiment it is connected to the graspers 332 via two helicoidally wound hose connections. The first of the two compressed air hoses 322 is for closing the graspers 332, and the second compressed-air hose 322 is for opening it, starting from the pressure-less setting.

A filter is provided before the air arrival and air evacuation opening of the compressor 320 to provide protection from the great amount of dust coming from the spinning units.

With appropriate placement of the air evacuation valve of the compressor 325 the evacuated air can be used to clean the air filter of the compressor 325 as well as to blow-clean the rail 47. This is advantageous because in spinning plants especially, a great amount of dust is produced which has a negative effect on the operability of the compressor 325 and of the electrically driven conveyor trolley.

The helicoidal compressed air hoses 322 have the advantage that they stretch on the one hand to the lowest point reached by the handling device 330, and on the other hand take up little space when the handling device 330 is pulled up. Catching or fouling of the compressed-air hoses 322 is thereby excluded. In another embodiment according to the invention the compressed air hoses 322 are wound and unwound on a roller, together with the synthetic-material band 337. The advantage of this embodiment consists in gentle handling of the compressed air hoses 322.

The winding of the synthetic-material band 337 is advantageously controlled by means of the incremental measuring device 343 as well as by means of the unloading switch 336. While the unloading switch 336 reacts to an unloading of the synthetic-material band 336, the winding and unwinding according to measured length of the synthetic-material band 337 makes it possible to carry out winding at different speeds. It is thus advantageous if the greater part of the length to be unwound is handled at a higher speed.

Shortly before reaching the predetermined unwinding length, the speed at which the synthetic-material band 337 is unwound is reduced. This affords the advantage that the slow gear is used shortly before an end position, causing the handling device 330 to stop gently.

The placement of the synthetic-material band 337 laterally, next to the rail 47 in such manner that the width of the synthetic-material band 337 extends in traveling direction makes it possible on the one hand to achieve great lateral stability, and on the other hand also stability with respect to oscillations in the direction of travel. This is further assisted by the widely spread out attachment points attaching the synthetic-material band 337 to the handling device 330.

FIGS. 14 and 15 show different patterns used to place bobbins of different diameters in the conveying container 51. For the sequence in which the bobbins are deposited, the characteristic principle applied is to deposit the bobbins in the conveying container 51 from the middle out. This depositing sequence offers the advantage that especially bobbins coming to lie at the edge of the container are certain to assume their predetermined position. In FIG. 14 the critical positions are those with the numbers 8, 9, 17, 18, 26 and 27. Here it is possible that the bobbins may accidentally roll into another, not wanted position as they are deposited, despite the low space requirements of the grasper 332. Thus it would be possible for example, that the bobbin of No. 8 might roll into the position of bobbin No. 6. However, if this position is already occupied, this ensures that the bobbin will remain in its predetermined position 8. This furthermore excludes the possibility for a location to be considered occupied in the central computer even though it is still vacant. In the containers 51 of FIGS. 14 and 15 several bobbins are arranged one after the other in the designated positions. Their number is advantageously four bobbins, as can be seen in FIG. 1.

The installation of the handling device 330 on the vehicle 7, and also the overall concept of the self-sufficient vehicle 7 makes it possible to advantageously achieve a depositing sequence according to the patterns shown in FIGS. 14 and 15. The depositing sequence is determined in the central computer 6 as a function of the different bobbin diameters in the conveying container 51. Due to the fact that the already occupied locations in the conveying container 51 are stored in the memory of the central computer 6, the depositing location for the following bobbins are found. Based on the next depositing location in line, the central computer determines the distance from the zero flag 45 to the stopping point of the vehicle 7 in the conveying command issued to said vehicle 7. Depositing in accordance with the filling pattern of FIG. 15 is shown in a top view in the conveying containers 51 of FIG. 1. Here it is easy to recognize that the conveying containers 51 are stationary during loading. Only the length of the travelling road from the zero flag 35 to the stopping point is varied.

FIG. 16 shows a side view of the handling device 330. This embodiment is of a handling device 330 to convey four bobbins 20. The graspers 332 are arranged at a distance from each other so that each bobbin can be seized by the graspers 332 at their winding. The handling device 330 is connected at attachments 346 to the synthetic-material band 337. The long distance separating the attachments 346 ensures that ascent and descent of the handling device 330 takes place with little oscillation. The graspers 332 are designed so that they have as large a surface as possible at the points where they touch the bobbins 20. This produces low surface pressure, whereby non-damaging handling of the bobbins 20 is ensured. The graspers 332 are mounted on the swiveling element 352 in such manner as to be capable of swiveling.

FIG. 17 shows a side view of the handling device 330. The attachment 346 is designed so that the synthetic-material band 337 can be placed on the attachments 346 over its entire width. A compressed-air cylinder 350 causes the graspers 332 to open and close. The compressed-air cylinder is connected articulately to the swiveling elements 352. The swiveling elements are connected articulately on the one hand to the rigid part of the handling device 330 and on the other hand to the graspers 332. An articulately mounted guiding rod 351 is furthermore provided between the rigid element of the handling device 330 and each grasper 332. Thanks to a parallelogram-like geometry of the pivotal points this guiding rod 351 ensures that the graspers 332 are always in a vertical position as they open and close. This ensures advantageously low lateral space requirement for the graspers 332 during opening. This has proven to be especially advantageous in depositing the bobbins 20 in immediate proximity of the walls of a conveying container 51. Furthermore non-damaging handling is thus ensured, since little friction occurs on the windings of the bobbins 20. The graspers 332 are mounted rotatably by means of the vertical rotating axle 353. This makes it possible to obtain such adaptation of the graspers 332 to conical bobbins that again as large a surface as possible of the graspers 332 comes into contact with the bobbins 20 since the graspers 332 adapt to the configuration of said bobbins.

While FIG. 17 shows the handling device 330 in a pressure position in which no bobbin is being conveyed, FIG. 18 shows halves of the handling device 330, one as it conveys bobbins 20 of small diameter, the other conveying bobbins 20 of large diameter. In this drawing it can be clearly seen that a parallelogram-like actuation of the graspers 332 takes place thanks to the arrangement of the pivotal points as well as of the guiding rod 351. The graspers 332 are therefore in a vertical position, whatever the bobbin diameter may be. Due to the fact that the graspers 332 surround the bobbin 20 only little, even a small opening of the handling device 330 is sufficient to ensure that the bobbin 20 is deposited safely.

FIG. 19 shows a vehicle 7 with safety devices 400, 410 and 420. The safety device 400 serves to secure the bobbins 20 in case of a power failure. A power failure could cause the handling device 330 to seize the bobbins with no longer sufficient security. Thanks to the safety device 400 the bobbins fall on the supporting surface of the safety device 400 from which they can again be taken up by the handling device 330 once power has returned to the vehicle. The safety device 400 is rotatably mounted on a rotating axle 401. If the handling device 330 is lowered, the pre-stressed safety device 400 is opened from the underside of the handling device. If the handling device 330 is raised again, i.e. if it moves again up to a platform 402 of the safety device 400, said safety device 400 rotates again around the rotational axle 401, together with platform 402 to be located under the bobbins 20. Platform 402 is an integral component of the safety device 400.

Safety device 410 serves as an anti-collision protection against preceding vehicles 7. In this embodiment it is an ultrasound sensor. It has been shown that an ultrasound sensor causes no problems, especially with optical transmission of the conveying command. An additional safety device 420 is a contact protection device installed on vehicle 7. The contact protection device triggers a signal to the drive of vehicle 7 upon contact with an obstacle. In an advantageous embodiment the motor first switches over to slow travel, then stops. It has been shown that the braking path is shorter in that case than when the drive is stopped immediately. When the obstacle is no longer in front of the vehicle 7, i.e. if the contact protection device has returned into its original position, the vehicle starts up again automatically.

An indicator 430 is furthermore provided on the vehicle 7. The indicator 430 can be moved from the position represented by solid lines into the position represented by broken lines. Thanks to the indicator 430 a rail switch can recognize in which direction the vehicle 7 must continue its travel to complete the conveying command. Depending on whether the indicator 430 is in its withdrawn or in its extended position, the switch is moved in straight forward position or in bifurcation position, for example.

The indicator 430 has furthermore the function of transmitting a signal to a point of deposit, to a control of the point of deposit and/or to the central computer to transmit information that conveyed goods have been deposited successfully. As soon as the vehicle 7 has assumed its depositing position and the goods have been deposited, indicator 430 is moved back into its extended position and is recognized by a sensor along the travelling road. This sensor then transmits the information to the control that the goods have been deposited in good order. This information can be used for the subsequent conveying commands to determine the precise depositing position for the following goods.

The instant invention does not relate exclusively to the embodiments shown in the figures. Thus for instance, the deposit of bobbins is not restricted to depositing them into conveying containers of the type described. It is just as possible, for example, to deposit the bobbins on small pallets or on sorted retaining sections. Thus, it is intended that the present invention cover the modifications and variations of this invention provided they come within the scope of the appended claims and their equivalents.

We claim:

1. A process for conveying textile goods from one or a plurality of receiving points to one or a plurality of deposit points, said process comprising the steps of:

preparing the goods to be conveyed at one or a plurality of receiving points;

detecting with a central computer that the goods at the receiving point are ready to be conveyed;

selecting with the central computer one or a plurality of desired deposit points for the goods to be conveyed;

determining with the central computer an appropriate itinerary for a vehicle to the receiving point, the deposit point, and to a waiting position;

forming a conveying command for the vehicle with the central computer, the conveying command including instructions on the receiving point, the deposit point, and the corresponding itinerary;

transmitting the conveying command from the central computer to a computing unit of the vehicle;

autonomously executing the conveying command with the vehicle without further direction from the central computer, the vehicle traveling to the receiving point, receiving the goods to be conveyed at the receiving point, traveling to the point of deposit and depositing the goods thereat, and informing the central computer of the execution of the conveying command; and setting required switch positions along a traveling road traveled by the vehicle by signalling from the vehicle to a switch control unit controlling the switch positions in order for the vehicle to execute the conveying command.

2. The process as in claim 1, wherein said selecting of a desired deposit point includes sorting the goods to be conveyed by assigning predetermined deposit points to certain of the receiving points for deposit of the goods in a sorted manner at the deposit points.

3. The process as in claim 2, wherein the goods are sorted at the deposit points according to any one of a number of processed characteristics of the goods.

4. The process as in claim 3, wherein the central computer determines the desired deposit point for the goods as a function of stored process variables of the goods received at the receiving points.

5. The process as in claim 1, wherein the textile goods conveyed are conical bobbins, further comprising rotating containers at the deposit point as a function of the conicity orientation of the arriving bobbins so that the bobbins are deposited within the container in a desired position.

6. The process as in claim 1 wherein the textile goods conveyed are conical bobbins, further comprising rotating the bobbins with a handling device of the vehicle as a function of the conicity orientation of the bobbins so as to deposit the bobbins in a desired position within a container at the deposit point.

7. The process as in claim 6, further comprising rotating the bobbins with individual grasping devices of the handling device about an axis perpendicular to the longitudinal axis of the bobbins.

8. A process for conveying textile goods from one or a plurality of receiving points to one or a plurality of deposit points wherein the goods are received at a predetermined receiving point by a transfer vehicle and are deposited at a predetermined deposit point by the transfer vehicle, said process comprising the steps of:

determining with a central computer an appropriate route for the vehicle from a waiting position to the receiving point, from the receiving point to the deposit point, and from the deposit point to the same or another waiting position;

forming a conveying command for the vehicle with the central computer, the conveying command including data on at least the receiving point, the deposit point, and the corresponding route therebetween;

transmitting the conveying command from the central computer to a computing unit of the vehicle;

autonomously executing the conveying command with the vehicle without further commands from the central computer, the vehicle traveling to the receiving point, receiving the goods to be conveyed at the receiving point, traveling to the deposit point and depositing the goods thereat, and traveling to the waiting position; and cyclically interrogating the receiving points with the central computer to determine the status of goods to be conveyed at the receiving points, the central computer selecting the predetermined receiving point from the interrogated receiving points.

9. The process as in claim 8, further comprising reporting execution of the conveying command by the vehicle to the central computer.

10. A process for conveying bobbins of textile goods from any one of a plurality of receiving points to any one of a plurality of deposit points, whereby the goods are received by a vehicle of an electrically driven conveyor trolley at a receiving point, are conveyed to and deposited at a deposit point, said process comprising:

cyclically interrogating the receiving points with a central computer to determined the status of readied goods to be conveyed thereon;

forming a conveying command for the readied goods determined at a receiving point, the conveying command including information on the respective receiving point, a predetermined deposit point selected by the central computer, and a route for the vehicle to execute the conveyance of goods from the receiving point to the deposit point;

transmitting the conveying command from the central computer to the vehicle;

autonomously executing the receiving conveying command with the vehicle; and reporting a command executed signal from the vehicle to the central computer once the conveying command has been executed.

11. The process as in claim 10, wherein the central computer formulates a conveying command causing the vehicle to receive readied goods from a plurality of receiving points before depositing the goods at the deposit point.

12. The process as in claim 10, wherein the conveying command is not formed by the central computer until the maximum number of goods which can be conveyed by the vehicle has been readied at one or a plurality of the receiving points.

13. The process as in claim 10, wherein the central computer formulates a conveying command causing the vehicle to deposit goods at a plurality of depositing points selected by the central computer.

14. The process as in claim 10, further comprising transmitting the conveying command from the central computer to the vehicle and the command executed signal from the vehicle to the central computer with optical transmission means between the central computer and vehicle.

15. The process as in claim 14, further comprising transmitting the conveying command from the central computer to the vehicle and the command executed signal from the vehicle to the central computer with infrared transmitting and receiving devices.

16. The process as in claim 10, further comprising transmitting the conveying command from the central computer to the vehicle and the command executed signal from the vehicle to the central computer only along a predetermined segment of the vehicle trolley.

17. The process as in claim 16, wherein the transmission of the conveying command and the command execute signal is done through electrical sliding circuits between the vehicle and the central computer along the segment of vehicle trolley.

18. The process as in claim 10, further comprising transmitting the conveying command from the central computer to the vehicle and the command executed signal from the vehicle to the central computer along any portion of the vehicle trolley.

19. The process as in claim 10, further comprising controlling the speed of the vehicle so that the vehicle is slowed along trolley segments of predetermined length preceding at least one of the receiving points and deposit points.

20. The process as in claim 19, wherein the speed of the vehicle is slowed preceding the receiving point and deposit point.

21. The process as in claim 10, further comprising measuring the distance between the vehicle and at least one of the receiving points and deposit points along a predetermined length of the trolley preceding the receiving point or deposit point so as to control stopping the vehicle at precisely the receiving point or deposit point.

22. The process as in claim 10, further comprising setting switches along the road travelled by the vehicle by signals from the vehicle so that the vehicle can follow the route determined by the central computer and contained in the conveying command.

23. The process as in claim 10, further comprising signalling a control device at the deposit point with the vehicle once the vehicle has completed depositing the goods at the deposit point.

24. The process as in claim 10, further comprising directing the vehicle to a side section of the conveyor trolley upon detection of an error condition in execution of the conveying command by the vehicle.

25. A conveying system for conveying textile goods from a predetermined receiving point to a predetermined deposit point, comprising:

a rail system, said rail system connecting one or a plurality of receiving points to one or a plurality of deposit points;

at least one propelled traveling vehicle configured to travel along said rail system, said vehicle comprising a handling device to receive the textile goods from a receiving point and to deposit the textile goods at a deposit point, said handling device being variably displaceable relative said vehicle and comprising a grasping device configured for grasping textile bobbins;

a central computer remote from and in operative communication with said traveling vehicle, said central computer for forming a conveying command for said vehicle, said conveying command identifying to said vehicle said predetermined receiving point, deposit point, and a route along said rail system therebetween; and a computing unit operatively configured with said vehicle, said computing unit for receiving said conveying command and causing said vehicle to execute said conveying command autonomous from said central computer, said computing unit controlling said handling device.

26. The system as in claim 25, comprising a plurality of said traveling vehicles, said traveling vehicles comprising electrically driven trollies wherein said trollies independently receive and simultaneously execute respective said conveying commands from said central computer.

27. The system as in claim 26, wherein said trollies are configured to execute said conveying commands substantially at the same time.

28. The system as in claim 25, further comprising switching flags disposed before each of said receiving points and said deposit points, and a switching flag control unit, said vehicle computing unit transmitting switching flag settings to said switch control unit to set said switching flags of said predetermined receiving and deposit points identified in said conveying command received from said central computer, said vehicle comprising an initiator device for addressing said switching flags, at least one of said switching flags acting upon the speed of said traveling vehicle and at least one of said switching flags operating with a distance measuring device carried by said vehicle.

29. The system as in claim 28, wherein said switching flags comprise a first counting flag for indicating position of said vehicle along said rail system, and a second zeroing flag to start said distance measuring device to determined the distance along said rail system until said vehicle reaches a predetermined halt point at either of said receiving point or said deposit point.

30. The system as in claim 29, wherein said first counting flag also causes the speed of said vehicle to be slowed.

31. The system as in claim 25, further comprising at least one sliding circuit disposed along said rail system, said sliding circuit for the transmission of data between said central computer and said computing unit of said vehicle.

32. The system as in claim 25, wherein said central computer further comprises an infrared transmission device for transmitting data to said vehicle, and said vehicle comprises an infrared receiving device for receiving data from said central computer.

33. The system as in claim 32, wherein said central computer further comprises an infrared receiving device for receiving data from said vehicle, and said vehicle comprises an infrared transmission device for transmitting data to said central computer.

34. The system as in claim 25, wherein said rail system is defined into block sections, and further comprising means for closing said block sections to travel by said vehicle.

35. An electrically driven trolley system for receiving, transporting, and depositing textile goods, comprising:

at least one propelled traveling vehicle, said vehicle further comprising at least a computing unit, driving equipment, and a handling device;

said handling device being variably displaceable relative said vehicle and comprising a grasping device configured for grasping textile bobbins, said handling device being controlled by said computing unit;

a central computer remote from said traveling vehicle and in communication with said computing unit, said central computer forming and transmitting a conveying command to said computing unit identifying to said vehicle any number of textile receiving points and deposit points, and wherein upon receipt of said conveying command, said vehicle is configured to autonomously travel to said receiving points, transfer the textile goods from the receiving points to said vehicle with said handling device, transport the textile goods to said deposit points, and deposit said textile goods at a predetermined position in containers at said deposit points.

36. The system as in claim 35, wherein said handling device comprises a pneumatic grasping device, said vehicle further comprising a compressed air supply for operating said pneumatic grasping device.

37. The system as in claim 35, wherein said grasping device comprises spaced apart grasping elements configured to grasp textile bobbins about their circumferential surface.

38. The system as in claim 37, wherein said grasping elements can be actuated independently of each other.

39. The system as in claim 37, wherein said grasping elements are pivoted relative said handling device so as to remain substantially vertical during opening and closing thereof, the opening width therebetween being defined essentially as a parallelogram.

40. The system as in claim 35, wherein said handling device is operatively connected to said vehicle by a variable length actuation device so that said handling device can be raised and lowered relative to said vehicle.

41. The system as in claim 40, wherein said handling device comprises spaced apart grasping elements configured to grasp textile bobbins about their circumferential surface, said variable length actuation device comprises flexible rollable bands connected to said grasping elements and a winding device for varying the length of said flexible bands thereby changing the height of said grasping elements relative said vehicle.

42. The system as in claim 41, wherein said winding device comprises a motor connected to a wind-up roller, and further comprising an unloading switch installed on said winding device for automatically shutting off said motor when said bands achieve an unloaded condition, said motor comprising a shift anchor motor which is braked in a no voltage condition.

43. The system as in claim 41, further comprising a metal detection body attached to at least one of said flexible bands generally at the end thereof opposite said grasping element, and metal sensor disposed essentially next to said flexible band so as to detect said metal detection body as said metal body passes thereby.

44. The system as in claim 41, wherein said handling device is rotatably installed on said vehicle so as to rotate about a vertical axis through said vehicle.

45. The system as in claim 41, wherein said grasping elements are rotatably installed on said handling device so as to rotate about a vertical axis through said handling device.

46. The system as in claim 41, wherein said grasping elements are pneumatically operated to securely grasp a textile bobbin, said vehicle further comprising a compressed air source for actuating said grasping elements.

47. The system as in claim 41, further comprising an incremental distance measuring device for accurately measuring the relative height of said handling device below said vehicle.

48. The system as in claim 41, further comprising an immobilizing device wherein said handling device can be immobilized in its uppermost position on said vehicle.

49. The system as in claim 48, wherein said immobilizing device comprises at least one elastic element for pre-stressing said handling device in its immobilized position.

* * * * *

UNITED STATES PATENT AND TRADEMARK OFFICE

CERTIFICATE OF CORRECTION

PATENT NO. : 5,402,355
DATED : March 28, 1995
INVENTOR(S) : Bernd Bahlmann et al.

It is certified that error appears in the above-indentified patent and that said Letters Patent is hereby corrected as shown below:

Column 28, line 60, delete "41" and substitute therefor --35--.

Signed and Sealed this

Fifth Day of September, 1995

*Attest:*

*Attesting Officer*

BRUCE LEHMAN

*Commissioner of Patents and Trademarks*